US009919890B2

(12) United States Patent
Nakano et al.

(10) Patent No.: US 9,919,890 B2
(45) Date of Patent: Mar. 20, 2018

(54) APPARATUS FOR PROCESSING SHEETS AND APPARATUS FOR FORMING IMAGES PROVIDED WITH THE SAME

(71) Applicants: Takahiro Nakano, Yamanashi-ken (JP); Takashi Saito, Yamanashi-ken (JP)

(72) Inventors: Takahiro Nakano, Yamanashi-ken (JP); Takashi Saito, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/245,419

(22) Filed: Aug. 24, 2016

(65) Prior Publication Data

US 2017/0057773 A1 Mar. 2, 2017

(30) Foreign Application Priority Data

Aug. 28, 2015 (JP) ..... 2015-168393
Aug. 28, 2015 (JP) ..... 2015-168394
Aug. 28, 2015 (JP) ..... 2015-168396

(51) Int. Cl.
*B65H 29/60* (2006.01)
*B65H 31/10* (2006.01)
(Continued)

(52) U.S. Cl.
CPC ..... *B65H 29/60* (2013.01); *B65H 29/125* (2013.01); *B65H 29/14* (2013.01); *B65H 31/10* (2013.01);
(Continued)

(58) Field of Classification Search
CPC .... B65H 29/60; B65H 31/26; B65H 31/3027; B65H 29/125; B65H 43/00;
(Continued)

(56) References Cited

U.S. PATENT DOCUMENTS

2003/0057641 A1* 3/2003 Yamada ..... B42C 1/12 271/298
2007/0045924 A1* 3/2007 Kamiya ..... B65H 31/3027 270/58.1
(Continued)

FOREIGN PATENT DOCUMENTS

JP 5248785 B2 7/2013

*Primary Examiner* — David H Bollinger
(74) *Attorney, Agent, or Firm* — Manabu Kanesaka

(57) ABSTRACT

An apparatus includes a transport path for transporting a sheet, a branch path branched off from the transport path to transport a sheet to a stacker, transport rollers on the transport path, branch rollers on the branch path, and a sheet processing control section controlling the rollers. The control section performs wait transport for switchback-transporting a sheet to cause the sheet to once wait in the branch path after the sheet transported in the transport path passes through a branch position, and transporting the sheet to a first processing tray together with a subsequent sheet, and second tray transport for switchback-transporting a sheet to transport to the stacker via the branch path after the sheet passes through the branch position, makes a switchback transport velocity in the second tray transport lower than that in switchback transport in the wait transport, and suppresses fluttering and bending of the sheet.

18 Claims, 24 Drawing Sheets

(51) Int. Cl.

| | |
|---|---|
| ***B65H 37/04*** | (2006.01) |
| ***B65H 43/00*** | (2006.01) |
| ***B65H 29/12*** | (2006.01) |
| ***B65H 29/14*** | (2006.01) |
| ***B65H 31/26*** | (2006.01) |
| ***B65H 31/30*** | (2006.01) |

(52) U.S. Cl.
CPC ..... *B65H 31/26* (2013.01); *B65H 31/3027* (2013.01); *B65H 37/04* (2013.01); *B65H 43/00* (2013.01); *B65H 2301/4212* (2013.01); *B65H 2301/4213* (2013.01); *B65H 2403/942* (2013.01); *B65H 2404/1521* (2013.01); *B65H 2404/632* (2013.01); *B65H 2404/693* (2013.01); *B65H 2511/11* (2013.01); *B65H 2511/20* (2013.01); *B65H 2511/415* (2013.01); *B65H 2513/10* (2013.01); *B65H 2801/27* (2013.01)

(58) Field of Classification Search
CPC ..... B65H 2403/942; B65H 2404/1521; B65H 2513/10; B65H 2511/415; B65H 2511/20; B65H 2511/11
See application file for complete search history.

(56) References Cited

U.S. PATENT DOCUMENTS

| | | | | |
|---|---|---|---|---|
| 2013/0228965 | A1* | 9/2013 | Hoshino | B65H 29/246 271/211 |
| 2014/0175728 | A1* | 6/2014 | Kimura | G03G 15/6541 270/1.01 |
| 2015/0266696 | A1* | 9/2015 | Saito | B65H 37/04 271/265.01 |
| 2015/0310316 | A1* | 10/2015 | Osada | G06K 15/16 358/1.12 |
| 2016/0009518 | A1* | 1/2016 | Ishikawa | B65H 29/125 271/298 |

* cited by examiner

APPARATUS FOR PROCESSING SHEETS AND APPARATUS FOR FORMING IMAGES PROVIDED WITH THE SAME

BACKGROUND OF THE INVENTION

1. Field of the Invention

The present invention relates to a processing apparatus for processing sheets carried out of an image formation apparatus such as a copier and printer, and particularly, to improvements in a sheet processing apparatus for enabling stable sheet transport to be performed in transporting sheets to different trays.

2. Description of the Related Art

Generally, a processing apparatus is widely known which collates sheets carried out of an image formation apparatus to bind. Further, an apparatus is also known which receives sheets in trays in different positions to perform end-face stitching for binding an end face of the sheet and saddle stitching processing for binding substantially the center in the sheet transport direction. Further, in the processing, it is also shown to cause a preceding sheet to wait and stay inside the apparatus without halting transport of a subsequent sheet as possible, so as to transport to the tray with the subsequent sheet.

For example, Japanese Patent Gazette No. 5248785 shows a straight path for guiding a sheet fed from an image formation apparatus to a first tray and a branch path branched off from the path to guide a sheet to a second tray. In the first tray is arranged an end-face stitching unit for performing binding on end faces of sheets, and in the second tray is arranged a saddle stitching unit for binding the middle portion in the transport direction of sheets.

Then, in the Japanese Patent Gazette No. 5248785, it is shown to perform the so-called wait transport where a subsequent sheet is once switchback-transported to the branch path to wait in order to ensure time for binding processing and the like in the first tray, and is transported with the following sheet. Further, to receive a sheet in the second tray, the sheet is once transported to the first tray side, is then switchback-transported to the branch path, and is transported via the branch path. Thus, by using the branch path branched off from the transport path as both the wait path and the carry-in path to the second tray, the paths are made compact, and it is possible to perform processing without halting a subsequent sheet.

As described above, the first tray and second tray are disposed in different positions to apply end-face stitching and saddle stitching to received sheets respectively, and generally, end-face stitching is to bind faces in the end portion of sheets, is thereby used heavily in sheets with relatively short lengths e.g. sheets of B5-size, A4-size and letter size, and is further required to perform processing at high velocity. On the other hand, saddle stitching for binding the middle portion in the transport direction of sheets is used heavily in sheets with relatively long lengths e.g. sheets of B4-size, legal size and A3-size. Thus, since the sheets are long, the time required for the processing is allowed to be relatively long, and has a moderate tendency.

Therefore, in the apparatus shown in the above-mentioned Japanese Patent Gazette No. 5248785, in the case of switching back sheets, which are to store in the first tray and perform end-face stitching, to once wait in the branch path, short sheets are not so long in the distance of switchback. Therefore, even when the sheets are transported at high velocity, bending and fluctuations of sheets do not occur so much in switchback transport, and deterioration of alignment characteristics, sheet jams and the like due thereto do not occur so much either. On the other hand, when the processing is performed at the same velocity in switching back sheets to store in the second tray and perform saddle stitching, since a relatively long distance undergoes switchback, bending and fluttering of sheets occurs, and there is a case where alignment characteristics deteriorate and/or a sheet jam occurs in collecting.

SUMMARY OF THE INVENTION

It is an object of the present invention to provide an apparatus for reducing bending and fluttering of a sheet also in transporting a relatively long sheet in switchback-transporting to carry in a different tray, and further preventing alignment characteristics from deteriorating with few occurrences of the sheet jam.

In order to attain the object, according to the first disclosure of the present invention, a sheet processing apparatus is provided with a transport path for receiving a sheet to transport the sheet to a first tray, a branch path branched off from the transport path to transport a sheet to a second tray, a first transport roller positioned in the transport path on the downstream side of a branch position of the transport path and the branch path to be able to transport a sheet in a direction of one of both the first tray and the branch path, a second transport roller positioned in the branch path to be able to transport a sheet in a direction of one of both the second tray and the transport path, and a control section for controlling the first transport roller and the second transport roller, where the control section performs wait transport for switchback-transporting a sheet to cause the sheet to once wait in the branch path after the sheet transported in the transport path passes through the branch position, and transporting the sheet to the first tray together with a subsequent sheet, and second tray transport for switchback-transporting a sheet to transport to the second tray via the branch path after the sheet transported in the transport path passes through the branch position, and makes a switchback transport velocity of the second tray transport different from a switchback transport velocity of the wait transport.

According to the second disclosure, a sheet processing apparatus is provided with a transport path for receiving a sheet to guide the sheet, a first tray positioned on the downstream side of the transport path to receive a sheet, a sheet discharge tray capable of moving up and down positioned on the downstream side of the first tray to collect a sheet discharged from an exit of the first tray, a branch path branched off from the transport path to guide a sheet, a second tray for receiving a sheet transported from the branch path, a first transport roller positioned in the transport path on the downstream side of a branch position of the transport path and the branch path to be able to transport a sheet to one of both the first tray and the branch path, a second transport roller positioned in the branch path to be able to transport a sheet to one of both the second tray and the transport path, and a control section for controlling the first transport roller, the second transport roller and the sheet discharge tray, where the control section performs wait transport for switchback-transporting a sheet to cause the sheet to once wait in the branch path after the sheet transported in the transport path passes through the branch position, and transporting the sheet to the first tray together with a subsequent sheet, and second tray transport for switchback-transporting a sheet to transport to the second tray via the branch path after the sheet transported in the transport path passes through the branch position, and in the second tray transport, an upper surface of the sheet discharge tray or an upper surface of the sheet placed on the sheet discharge tray shifts to a position for guiding a sheet undergoing switchback transport.

According to the third disclosure, a sheet processing apparatus is provided with a transport path for receiving a sheet to guide the sheet, a first tray positioned on the downstream side of the transport path to receive a sheet, a sheet discharge tray capable of moving up and down positioned on the downstream side of the first tray to collect a sheet discharged from an exit of the first tray, a branch path branched off from the transport path to guide a sheet, a second tray for receiving a sheet transported from the branch path, a first transport roller positioned in the transport path on the downstream side of a branch position of the transport path and the branch path to be able to transport a sheet to one of both the first tray and the branch path, a second transport roller positioned on the branch path to be able to transport a sheet to one of both the second tray and the transport path, an auxiliary guide provided to extend above the sheet discharge tray or above the sheet collected on the sheet discharge tray and shift between a guide position for guiding a sheet transported from the exit of the first tray and a storage position stored below the first tray, and a control section for controlling the first transport roller, the second transport roller and a shift of the auxiliary guide, where the control section performs wait transport for switchback-transporting a sheet to cause the sheet to once wait in the branch path after the sheet transported in the transport path passes through the branch position, and transporting the sheet to the first tray together with a subsequent sheet, and second tray transport for switchback-transporting a sheet to transport to the second tray via the branch path after the sheet transported in the transport path passes through the branch position, and in the second tray transport, shifts the auxiliary guide to the guide position to guide the sheet undergoing switchback transport.

According to the fourth disclosure, a sheet processing apparatus is provided with a transport path for receiving a sheet to transport the sheet to a first tray, a branch path branched off from the transport path to transport a sheet to a second tray, a first transport roller positioned in the transport path on the downstream side of a branch position of the transport path and the branch path to be able to transport a sheet in a direction of one of both the first tray and the branch path, a second transport roller positioned on the branch path to be able to transport a sheet in a direction of one of both the second tray and the transport path, and a control section for recognizing a transport length of the sheet transported by the first transport roller and the second transport roller, and controlling the first transport roller and the second transport roller, where the control section performs wait transport for switchback-transporting a sheet to cause the sheet to once wait in the branch path after the sheet transported in the transport path passes through the branch position, and transporting the sheet to the first tray together with a subsequent sheet, and second tray transport for switchback-transporting a sheet to transport to the second tray via the branch path after the sheet transported in the transport path passes through the branch position, and changes a transport velocity of the switchback-transporting corresponding to the transport length of the sheet.

According to each of the above-mentioned disclosures, it is possible to provide a sheet processing apparatus for reducing bending and fluttering of a sheet also in transporting a relatively long sheet in switchback-transporting to carry in a different tray, and further preventing alignment characteristics from deteriorating with few occurrences of the sheet jam, and an image formation apparatus provided with the sheet processing apparatus.

BRIEF DESCRIPTION OF THE DRAWINGS

FIG. 6A is an explanatory view for starting switchback in a transport path, and FIG. 6B is a state explanatory view for successively transporting from the transport path to a branch path;

FIG. 7A is an explanatory view where a preceding sheet waits in the branch path, and a next sheet is carried in, and FIG. 7B is another explanatory view for successively starting transport of the next sheet and the waiting preceding sheet together;

FIG. 8A is an explanatory view of a state in which the preceding sheet and next sheet are stored in the first processing tray together, and FIG. 8B is an state explanatory view for successively carrying a third sheet in;

FIG. 9A is an explanatory view for starting switchback in the transport path, and FIG. 9B is a state explanatory view for successively switchback-transporting from the transport path to the branch path at low velocity;

FIG. 10A is an explanatory view for transporting a preceding sheet to the branch path and receiving a next sheet to perform passing transport, and FIG. 10B is another explanatory view for storing the preceding sheet in the stacker (second processing tray) and transporting the next sheet;

FIG. 14A is a state explanatory view where switchback is started in the transport path and prior thereto, the first sheet discharge tray is moved up to the first processing tray exit, and FIG. 14B is another state explanatory view where switchback transport is successively performed from the transport path to the branch path at low velocity and the first sheet discharge tray is positioned in an ascent position;

FIG. 15A is a state explanatory view for transporting a preceding sheet to the branch path and receiving a next sheet to perform passing transport with the first sheet discharge tray positioned in the ascent position, and FIG. 15B is another state explanatory view for storing the preceding sheet in the stacker (second processing tray) and transporting the next sheet with the first sheet discharge tray positioned in the ascent position;

FIG. 16A is a state explanatory view where switchback is started in the transport path and prior thereto, the first sheet discharge tray shifts to a descent position, and FIG. 16B is another state explanatory view where the sheet is successively transported from the transport path to the branch path and the first sheet discharge tray is positioned in the descent position;

FIG. 19A is an auxiliary guide drive explanatory view, and FIG. 19B is a partial enlarged perspective view of the auxiliary guide;

FIG. 20A is an explanatory view for starting switchback in the transport path, and FIG. 20B is a state explanatory view for successively switchback-transporting from the transport path to the branch path at low velocity;

FIG. 21A is an explanatory view for transporting a preceding sheet to the branch path and receiving a next sheet to perform passing transport, and FIG. 21B is another explanatory view for storing the preceding sheet in the stacker (second processing tray) and transporting the next sheet;

FIG. 22A is an explanatory view for starting switchback in the transport path, and FIG. 22B is a state explanatory view for successively transporting from the transport path to the branch path;

FIG. 23A is an explanatory view for starting switchback in the transport path, and FIG. 23B is a state explanatory view for successively transporting from the transport path to the branch path.

DESCRIPTION OF THE EMBODIMENTS

Figure 1:
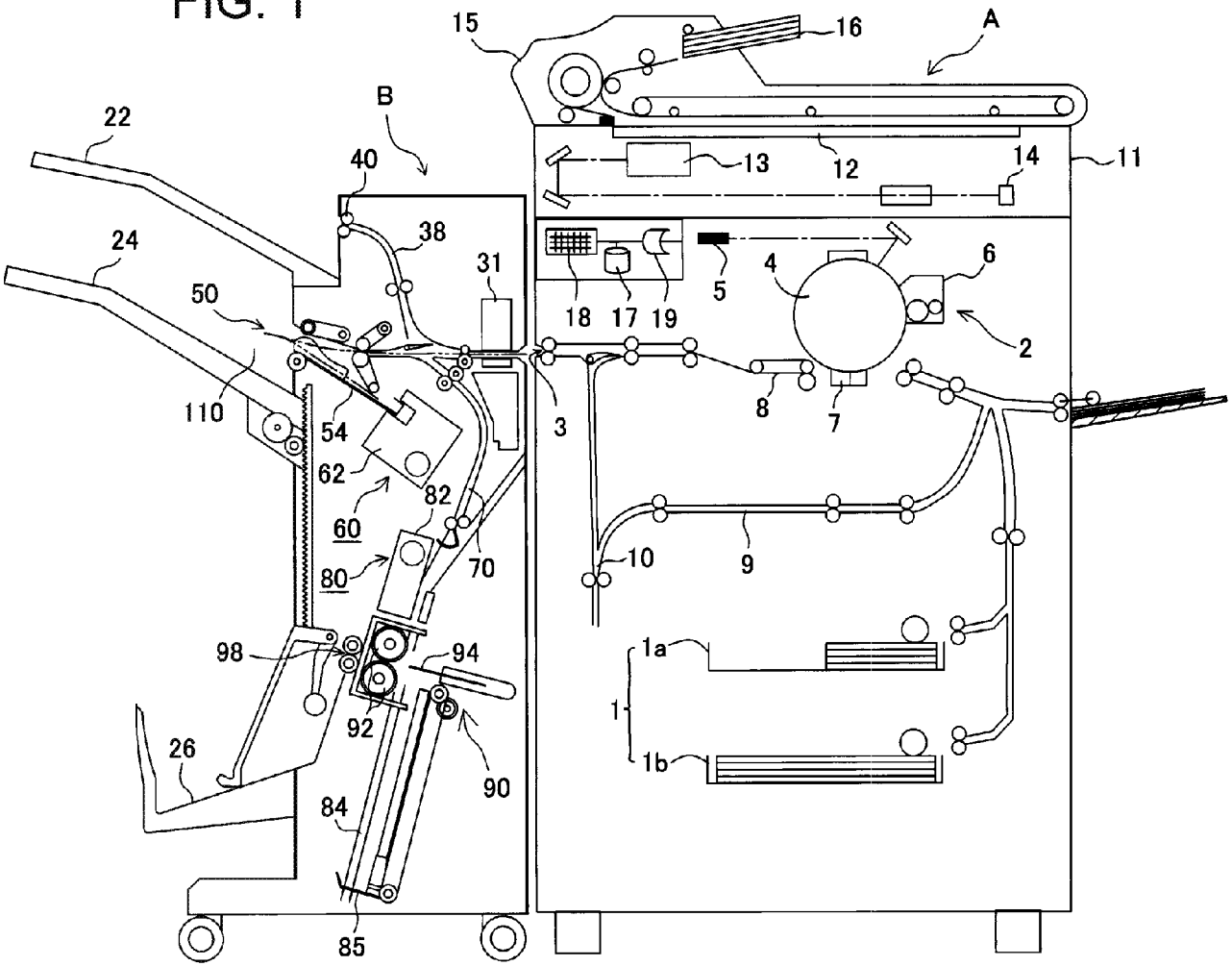
FIG. 1 is an explanatory view illustrating an entire configuration obtained by combining an image formation apparatus and sheet processing apparatus according to the present invention.
Figure 2:
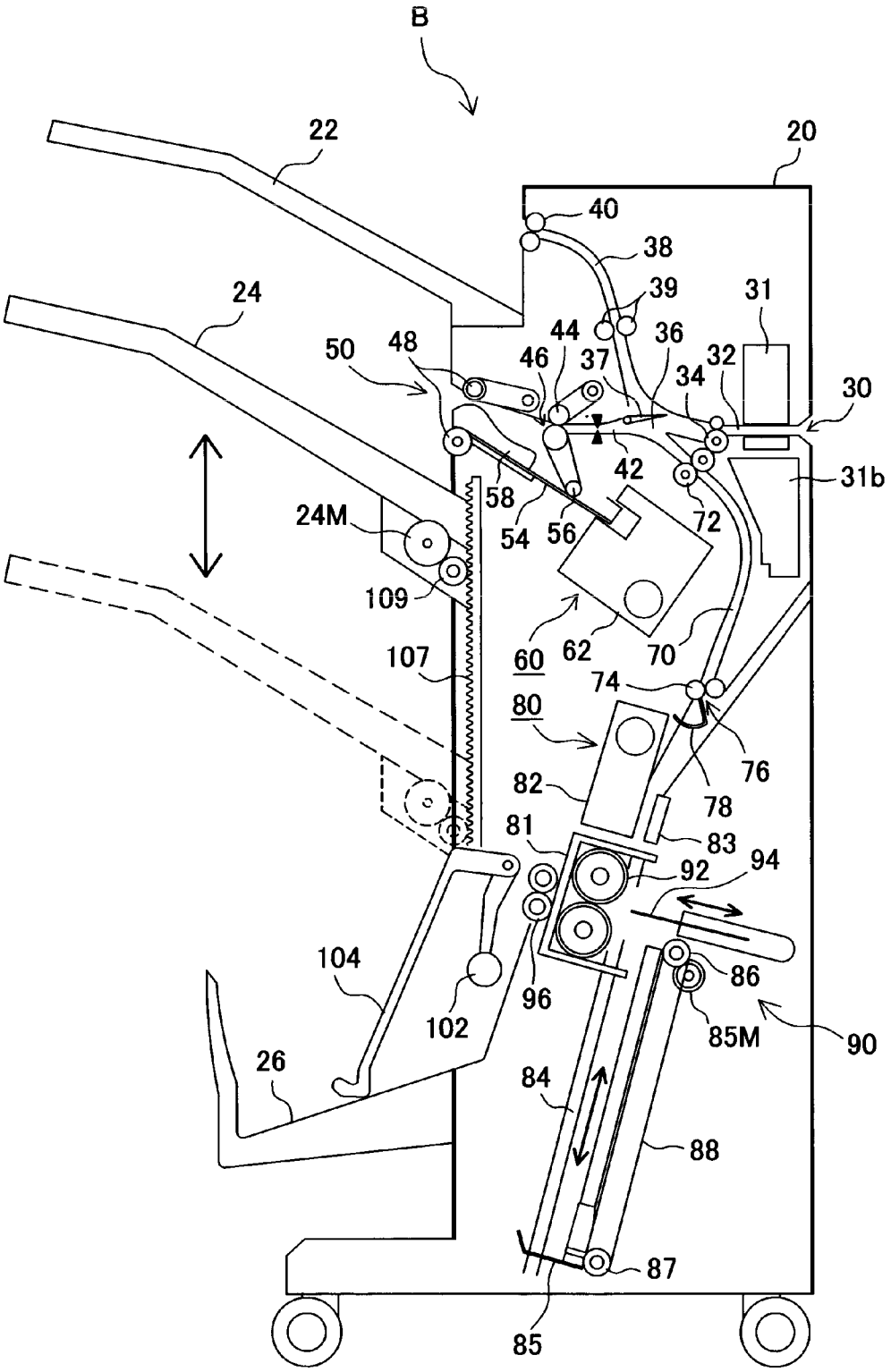
FIG. 2 is an entire explanatory view of the sheet processing apparatus provided with an end-face stitching unit and saddle stitching unit according to the invention.

The present invention will specifically be described below based on preferred Embodiments of the invention shown in drawings. FIG. 1 is an entire configuration view illustrating an image formation system provided with an image formation apparatus A and sheet processing apparatus B according to the invention, and FIG. 2 is an explanatory view of a detailed configuration of the sheet processing apparatus B.

In addition, in the accompanying drawings, similar components through the entire Description are represented by adding the same reference numerals.

[Image Formation System]

The image formation system shown in FIG. 1 is comprised of the image formation apparatus A and sheet processing apparatus B. Then, a carry-in entrance 30 of the sheet processing apparatus B is coupled to a main-body discharge outlet 3 of the image formation apparatus A, and it is configured that sheets with images formed in the image formation apparatus A are staple-bound in the sheet processing apparatus B and are stored in a first sheet discharge tray 24 or second sheet discharge tray 26. Further, above the sheet discharge tray 24 is arranged an escape tray 22 to directly store sheets without performing binding processing.

[Image Formation Apparatus A]

The image formation apparatus A will be described according to FIG. 1. The image formation apparatus A is configured to feed a sheet from a paper feed section 1 to an image formation section 2, print on the sheet in the image formation section 2, and then, discharge from the main-body discharge outlet 3. The paper feed section 1 stores sheets of a plurality of sizes in paper feed cassettes 1*a*, 1*b*, and separates designated sheets on a sheet-by-sheet basis to feed to the image formation section 2.

For example, in the image formation section 2 are disposed an electrostatic drum 4, and a printing head (laser light-emitting device) 5, development device 6, transfer charger 7 and fuser 8 disposed around the drum. The image formation section 2 forms an electrostatic latent image on the electrostatic drum 4 with the laser light-emitting device 5, adds toner to the image with the development device 6, transfers the image onto a sheet with the transfer charger 7, and fuses with the fuser 8 to form an image. The sheet with thus image formed is sequentially carried out from the main-body discharge outlet 3. "9" shown in the figure denotes a circulation path which is a path for two-side printing for reversing the side of the sheet with printing made on the frontside from the fuser 8 via a switchback path 10, and then feeding to the image formation section 2 again to print on the backside of the sheet. The sheet thus subjected to two-side printing is reversed in the switchback path 10, and then, is carried out from the main-body discharge outlet 3.

"11" shown in the figure denotes an image reading apparatus, and the apparatus scans an original document sheet set on platen 12 with a scan unit 13 to electrically read with a photoelectric converter not shown. For example, the image data is subjected to digital processing in an image processing section, and then, is transferred to a data storage section 14, and an image signal is sent to the laser light-emitting device 5. Further, "15" shown in the figure denotes an original document feeding apparatus, and the apparatus feeds original document sheets stored in an original document stacker 16 to the platen 12.

Figure 13:
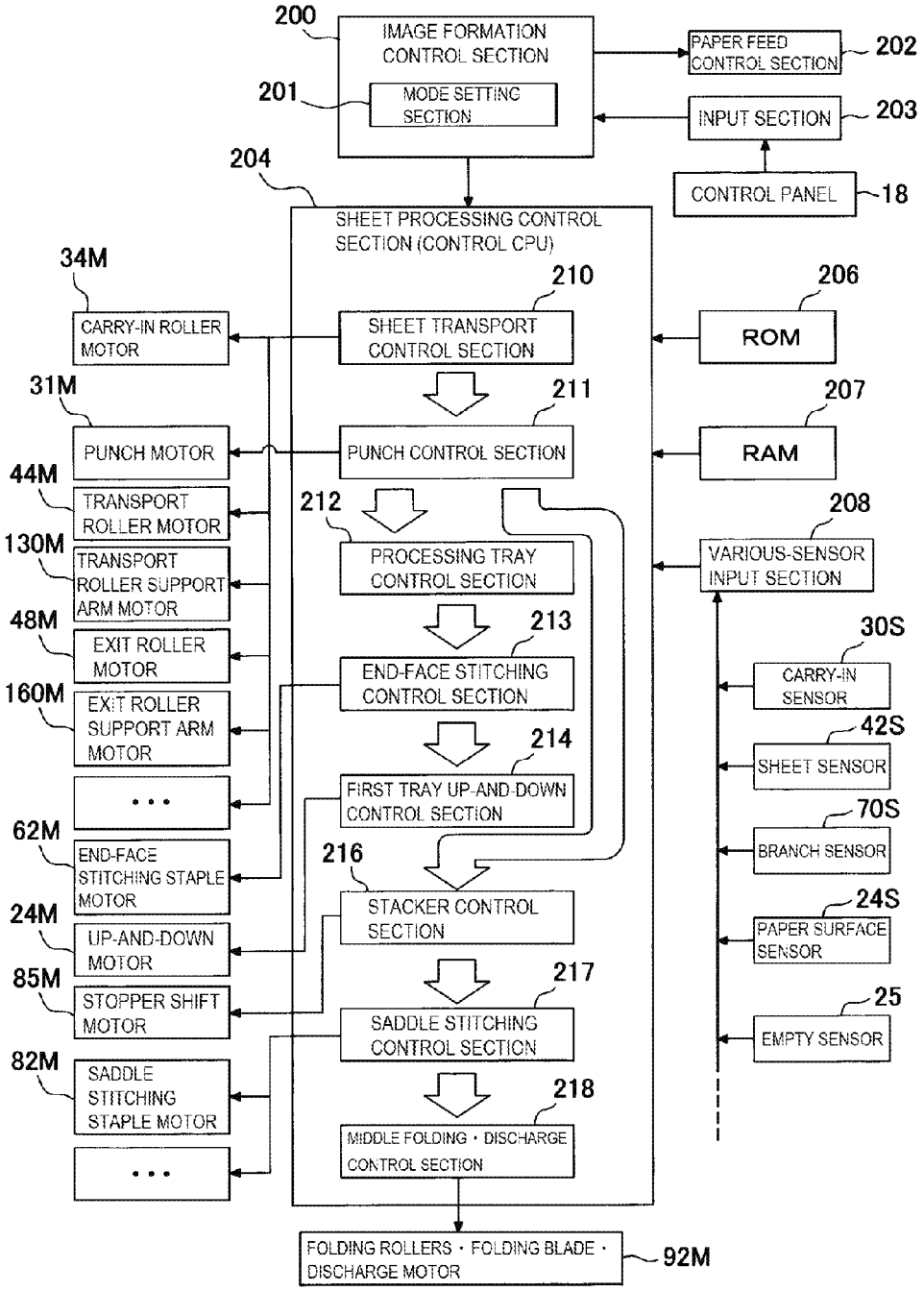
FIG. 13 is a block diagram of a control configuration in the entire configuration of FIG. 1.

The image formation apparatus A with the above-mentioned configuration is provided with an image formation control section 200 shown in FIG. 13, and from a control panel 18 via an input section 203, is set for image formation conditions e.g. sheet size designation, color/monochrome printing designation, the number of print copies designation, one-side/two-side printing designation and enlarged/reduced printing designation as printing conditions. Further, the image formation apparatus A stores the image data read with the scan unit 13 or image data transferred from an external network in a data storage section 17. It is configured that the image data is transferred from the data storage section 17 to a buffer memory 19, and that the buffer memory 19 sequentially transfers a data signal to the laser light-emitting device 5.

Concurrently with the above-mentioned image formation conditions such as one-side/two-side printing, enlarged/reduced printing and monochrome/color printing, a sheet processing condition is also input and designated from the control panel 18. As the sheet processing condition, for example, a "print-outmode", "end-face stitching mode", "saddle stitching mode" or the like is set. In addition, these processing conditions will be described later.

[Sheet Processing Apparatus B]

In the sheet processing apparatus B, as shown in FIGS. 1 and 2, in an apparatus frame 20 are disposed the carry-in entrance 30 of a sheet provided on one side, and the escape tray 22 provided on the outer side opposite to the entrance to collect a single sheet or relatively thick sheet. Below the escape tray 22, the first sheet discharge tray 24 is positioned which is able to move up and down to collect sheets subjected to end-face stitching processing and a relatively large amount of sheets. Further, below the first sheet discharge tray 24 is provided the second sheet discharge tray 26 that collects sheets subjected to saddle stitching or folding processing. In addition, in the invention, the end face indicates a face around an end portion of a sheet i.e. frontside and backside of a sheet edge portion.

[Transport Path of a Sheet]

From the carry-in entrance 30 of the sheet processing apparatus B, a transport path 42 is disposed which extends substantially linearly from a carry-in path 32 to a first processing tray exit 50. The carry-in path 32 is provided with a punch unit 31 to perform punch processing in the end face of a sheet and as necessary, the middle portion in the transport direction. Below the punch unit 31 across the carry-in path 32, a punch dust box 31*b* for collecting punch dust generated in the punch processing is provided in the apparatus frame 20 to be attachable/detachable.

On the downstream side of the punch unit 31, a carry-in roller 34 for transporting a sheet is disposed to transport the sheet at a high velocity. In the transport path 42 on the downstream side of the carry-in roller 34 are provided forward/backward rotation-capable transport rollers 44 that guide a sheet to a first processing tray 54 that is a first tray and the first sheet discharge tray 24 on the downstream side thereof. The rear of the transport roller 44 is a transport path exit 46 of the sheet.

On the downstream side of the transport path exit 46 are provided forward/backward rotation-capable exit rollers 48. The exit rollers 48 switches a sheet back to transport the sheet to the first processing tray 54, discharges to the first sheet discharge tray 24 straight, or discharges a bunch of sheets which are collected on the first processing tray 54 and subjected to end-face stitching processing to the first sheet discharge tray 24.

[Escape Path, Branch Path]

Further, the transport path 42 is branched, in a branch position 36, to an escape path 38 for guiding a sheet to the escape tray 22, and a branch path 70 for guiding a relatively long sheet to a stacker 84 (that is also a second processing tray) which is the second tray to perform saddle stitching processing and folding processing. In the branch position 36 is provided a switch gate 37 of the path to select transporting the sheet to the transport path 42 directly, transporting to the escape path 38, or switching back on the transport path 42 to guide to the branch path 70.

In addition, the escape path 38 is provided with escape rollers 39 that transport a sheet, and escape exit roller 40 that discharges the sheet to the escape tray 22.

[End-face Stitching Section]

In addition, the first processing tray 54 is provided below the transport path exit 46 of the transport path 42, and on the lower end side thereof, an end-face stitching section 60 is positioned to bind end faces of sheets temporarily collected on the first processing tray 54. The end-face stitching section 60 will be described later with reference to FIG. 3.

[Saddle Stitching Section]

On the other hand, a relatively long sheet is once transported in the transport path 42 in the direction of the first processing tray 54, is transported to the downstream side of the switch gate 37, is then switchback-transported at this time to transport to the branch path 70, and is collected in the stacker 84 (second tray) from a branch exit 76. In the stacker 84 is disposed a saddle stitching section 80 that binds the middle portion of collected sheets. As shown in FIG. 2, the branch exit 76 is provided with a change flapper 78 that biases a sheet to the left side as viewed in the figure whenever the sheet is carried in the stacker 84 from the branch exit roller 74 to prevent a collision of a preceding sheet rear end and a next sheet front end from occurring.

[Stacker (Second Processing Tray/second Tray)]

In the stacker 84 is positioned a stopper 85 for defining a carry-in position of a sheet. The stopper 85 shifts in the arrow direction shown in the figure, by driving a shift belt 88 provided in a tensioned state between an upper pulley 86 and a lower pulley 87 on the side of the stacker 84 by a stopper shift motor 85M. A position of the stopper 85 is halted in each of a position for enabling a rear end of a sheet to be changed by the change flapper 78 when the sheet is carried in the stacker 84, a position for performing saddle stitching substantially on the center in the transport direction of sheets with the saddle stitching unit 82, and a position for pushing the saddle-stitched position to a folding roller 92 pair with a reciprocating folding blade 94 to fold a bunch of sheets in two.

Further, in the upper and lower portions of the folding rollers 92 is provided a saddle stitching alignment plate 81 that presses opposite side edges of a sheet from the sheet width direction to perform alignment operation whenever the sheet is carried in the stacker 84.

[Saddle Stitching Unit]

In the saddle stitching section 80, for example, a staple is driven in a bunch of sheets by a driver inside the saddle stitching unit 82, and an anvil 83 is provided in a position opposite thereto to bend leg portions of the staple. The saddle stitching unit 82 is already known widely, and the description herein is omitted. In addition, as a binding means, not only the means for piercing a bunch of sheets with a staple to bind, a mechanism may be adopted where an adhesive is applied to the center in the transport direction of a sheet and sheets are bound to be a bunch.

[Second Sheet Discharge Tray]

The bunch of sheets bound by the saddle stitching unit 82 is folded in two by the folding rollers 92 and folding blade 94 for pushing the bunch of sheets into the rollers, and is discharged to the second sheet discharge tray 26 by the folding rollers 92 and bunch discharge roller 96 positioned on the downstream side of the roller 92. To the second sheet discharge tray 26 are attached a swingable press roller 102 with the rotatable roller provided in the front end to drop the folded bunch of sheets, which is subjected to the folding processing and discharged with the rear side as the front end side, into the second sheet discharge tray 26, and a press lever 104 that presses from above not to expand collected folded bunches of sheets. The press roller 102 and press lever 104 reduce decrease in collection characteristics due to the fact that the folded bunch of sheets is open.

[Branch Position and End-face Stitching Section]

Figure 3:
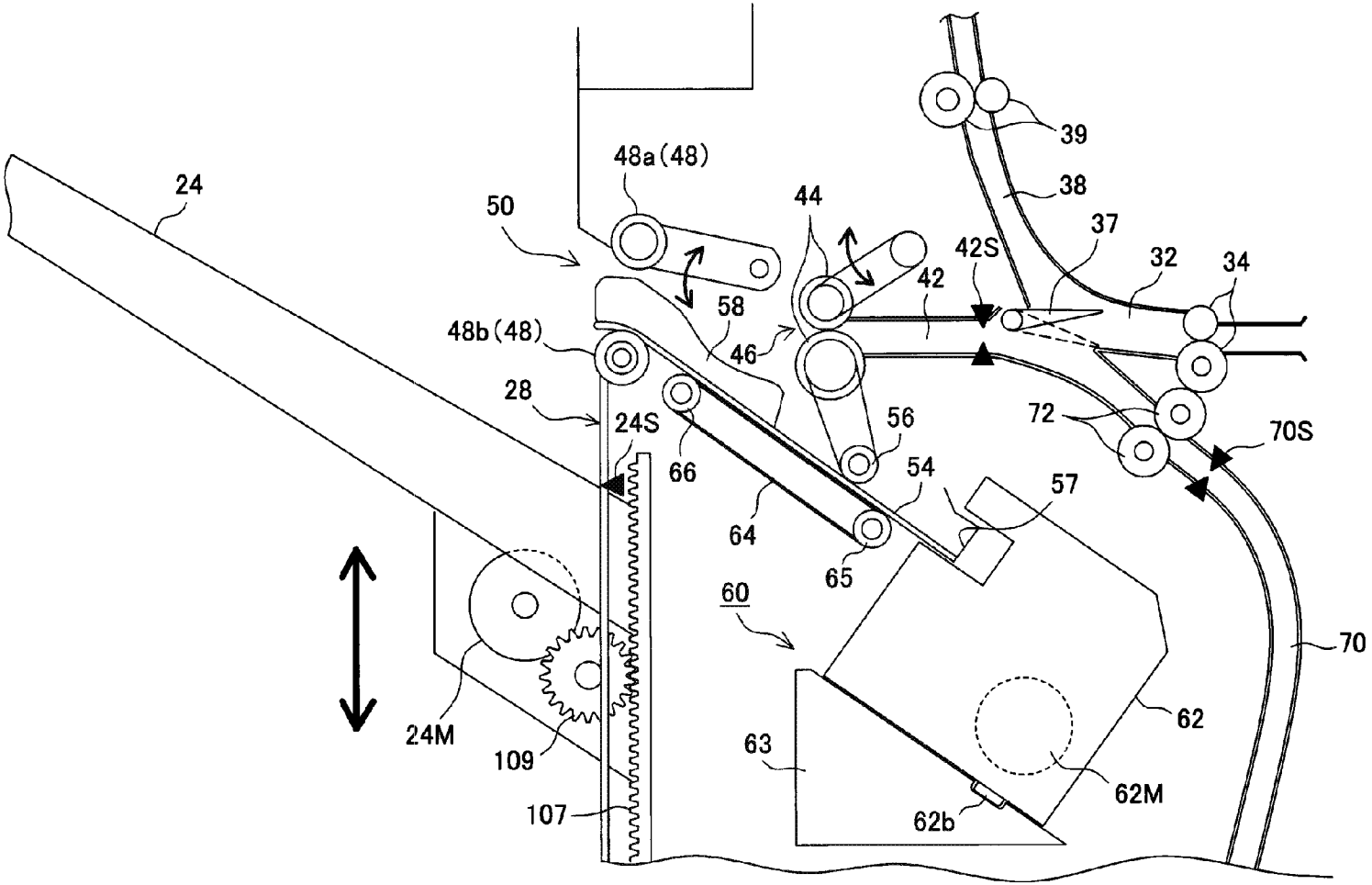
FIG. 3 is an enlarged side explanatory view on the periphery of an end-face stitching section.

Herein, with respect to the branch position 36 and end-face stitching section 60, further descriptions will be added with reference to FIG. 3. As described already, FIG. 3 illustrates the carry-in path 32 from the carry-in entrance 30 with the carry-in rollers 34 disposed, the transport path 42 linearly extending from the path 32 in the direction of the first processing tray 54, the escape path 38 extending upward as viewed in the figure from the transport path 42, and the branch path 70 curved downward to guide the sheet to the stacker 84. In the branch position 36 is disposed the change flapper 37 for selectively positioning and guiding the sheet in the carry-in path 32 to the escape path 38 or transport path 42, or the sheet switchback-transported in the transport 42 to the branch path 70.

In this Embodiment, for example, as shown in FIG. 3, the escape path 38 is blocked in the solid-line position to guide the sheet from the carry-in path 32 to the transport path 42, and in the dashed-line position, it is indicated that the sheet transported from the carry-in path 32 is guided to the escape path 38, and that the sheet switchback-transported from the transport path 42 is guided to the branch path 70.

In the above-mentioned transport path 42, the transport rollers 44 which rotate forward/backward while mutually contacting and separating are disposed immediately before the transport path exit 46 that is the last end. In other words, the transport rollers 44 are capable of transporting the sheet to the first processing tray 54 side by one-direction rotation in a press-contact state, and of switchback-transporting in the opposite direction by the other rotation.

[In Regard to Switchback Transport]

The switchback transport is performed by rotating the transport rollers 44 in the other direction, after a sheet sensor 42S disposed immediately after the switch gate 37 of the transport path 42 detects passage of the sheet rear end. In the other rotation, the switch gate 37 is shifted to the position (dashed-line position in FIG. 3) for blocking the carry-in path 32, the sheet is thereby transported to the branch path 70, and when the sheet rear end that is continuously transported by the branch rollers 72 arrives at a predetermined position, the branch rollers 72 are halted to make the sheet a wait state in the branch path 70.

In addition, in the first processing tray exit 50 (exit of the first processing tray 54) on the downstream side of the transport roller 44, the exit rollers 48 are disposed which rotate forward/backward, while mutually contacting and separating. The exit rollers 48 are comprised of an exit upper roller 48*a* and an exit lower roller 48*b*, and by one-direction rotation in a mutually press-contact state, cooperate with the transport rollers 44 to transport the sheet to the first sheet discharge tray 24. Further, the exit rollers 48 are also used in cooperating with a shift of a reference surface 57 described later to discharge sheets collected in the first processing tray 54 as a bunch to the first sheet discharge tray 24.

[Collection in the First Processing Tray 54]

Herein, collection of sheets in the first processing tray 54 will be described. For collection in the first processing tray 54, a sheet released from the transport rollers 44 is transported to the right side in FIG. 3 on an inclined surface of the first processing tray 54 by the other rotation of the exit rollers 48 positioned on the downstream side. The transported sheet is carried by rotating a take-in roller 56 around which a belt 146 with protrusions is wound in a counterclockwise direction as viewed in the figure. By this carry, the front end in the transport direction of the sheet comes into contact with the reference surface 57 that is a binding reference of the other surface and halts. At this point, the take-in roller 56 slides on the sheet to prevent the sheet from buckling after the sheet front end comes into contact with the reference surface. In other words, the exit rollers 48 have the function of switchback-transporting the sheet discharged from the transport rollers 44 to feed to the reference surface 57 of the first processing tray 54.

[End-face Stitching Unit Shift and Binding Processing]

The sheet is fed to the reference surface 57 by the rotation of the exit rollers 48 and take-in roller whenever the sheet is released from the transport rollers 44 to stack on the first processing tray 54. Further, in accordance with the stacking operation, alignment plates 58 are brought into contact from opposite sides in the sheet width direction to align the sheet in the center in the width direction of the first processing tray 54. Such stacking and alignment is repeated up to the predetermined number of sheets as a bunch. When the predetermined number of sheets is collected, at this point, the end-face stitching unit 62 that shifts in the sheet width direction on the end face of the sheets on a shift bench 63 is shifted to a desired binding position. This shift is made by that a shift pin 62*b* of the end-face stitching unit 62 is fitted into a groove rail shown in the figure provided in the sheet width direction on the shift bench 63 and is guided.

The binding processing of the end-face stitching unit 62 is already publicly known, and the description is omitted. When the end-face stitching unit 62 is halted in a designated binding position, an end-face stitching motor 62M is driven to rotate and shift a driver not shown to drive a staple in a bunch of sheets, the driven staple is bent by an anvil, and the binding processing is performed. The binding processing is performed in the end face of the corner or a plurality of positions in the end face in the width direction of sheets.

[Discharge of Sheets Subjected to End-face Stitching]

In a bunch of sheets subjected to the binding processing in the end-face stitching unit 62, by a shift of a reference surface shift belt 64 looped between a right pulley 65 and a left pulley 66 under the first processing tray 54 in a counterclockwise direction as viewed in the figure, the reference surface 57 coupled to the reference surface shift belt 64 shifts in the left direction as viewed in the figure, and thereby pushes the binding end face side of the bunch of sheets toward the first sheet discharge tray 24. Together with the push, the exit rollers 48 disposed in the exit of the first processing tray 54 press the bound bunch of sheets from frontside and backside, and discharge the bound bunch of sheets to the first sheet discharge tray 24 by rotation in a clockwise direction.

[Up-and-down of the First Sheet Discharge Tray]

The first sheet discharge tray 24 to collect a bunch of sheets will be described. As shown in FIG. 3, the first sheet discharge tray 24 is disposed with the inclined angle being substantially the same as that of the first processing tray 54, and collects the bound bunch of sheets discharged from the first processing tray 54 and also each sheet discharged from the transport path 42 by the transport rollers 44 and exit rollers 48.

On the bottom side of the first sheet discharge tray 24 is provided an up-and-down motor 24M that moves the first sheet discharge tray 24 up and down, and the drive is conveyed to an up-and-down pinion 109. The up-and-down pinion 109 engages in an up-and-down rack 107 provided vertically on the opposite sides of a standing surface 28 of the apparatus frame 20 fixedly. Further, although not shown in the figure particularly, an up-and-down rail provided on the standing surface 28 of the first sheet discharge tray 24 is to guide vertically.

The position of the first sheet discharge tray 24 or the position of sheets collected on the first sheet discharge tray 24 is detected with a paper surface sensor 24S provided in the standing surface 28. Then, when the paper surface sensor 24S detects, the up-and-down motor 24M is driven, and the up-and-down pinion 109 rotates to move down. The state in FIG. 3 is a state in which the paper surface sensor 24S detects the upper surface of the first sheet discharge tray 24, and the tray slightly moves down from the position to receive a bunch of sheets. Accordingly, the upper surface of the exit position from the first processing tray 54 and the upper surface of the first sheet discharge tray 24 are positioned with a height difference held.

Figure 4:
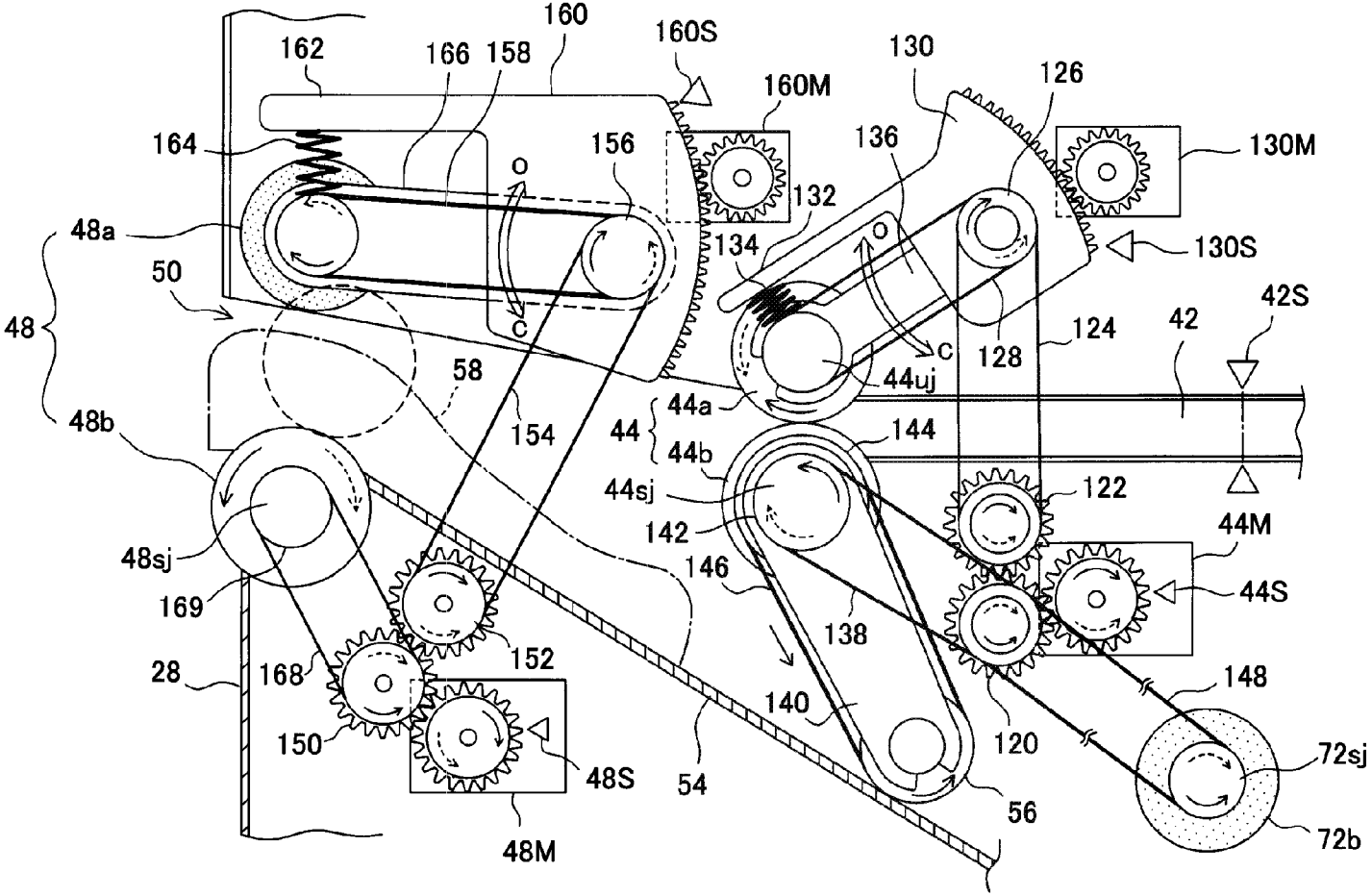
FIG. 4 is a drive explanatory view of transport rollers, exit rollers and branch rollers.

Referring to FIG. 4, a configuration of rotation drive and separate/contact of the transport rollers 44 and exit rollers 48 will be described next.

[Rotation Drive of the Transport Upper Roller]

First, drive of the transport rollers 44 comprised of the transport upper roller 44*a* and transport lower roller 44*b* is performed by a transport roller motor 44M. The transport roller motor 44M is comprised of a hybrid type stepping motor, and in the motor is disposed a speed detection sensor 44S that detects a rotation speed of the motor shaft. Drive of the transport roller motor 44M is transferred to an arm gear 126 via transmission gears 120, 122 and transmission belt 124. The drive from the arm gear 126 is transferred to an upper roller shaft 44*uj* of the transport upper roller 44*a* supported by a transport roller support arm 136 with a transmission belt 128.

[Separate/contact of the Transport Upper Roller]

Further, the transport upper roller 44*a* is attached to rotate on the shaft of the arm gear 126 so as to separate from and contact the fixed transport lower roller 44*b*. The separate/contact is performed by a transport roller shift arm 130 having a rear sector-shaped gear attached to the shaft of the arm gear 126 where a spring 134 to bias the transport upper roller 44*a* is attached to a shift arm point on the front side. In other words, by driving to rotate forward and backward the transport roller shift arm motor 130M engaging in the above-mentioned rear sector-shaped gear, the roller shifts in a release direction of the arrow O by rotation in one direction, and shifts in a press-contact direction of the arrow C for coming into press-contact with the transport lower roller 44*b* by rotation in the other direction. In addition, the transport roller shift arm motor 130M is also comprised of a stepping motor, and a transport roller shift arm sensor 130S detects a position of the transport roller shift arm 130.

[Rotation Drive of the Transport Lower Roller, Etc.]

Rotation drive of the transport lower roller 44*b* is performed by transferring drive of the transport roller motor 44M to a receive gear 142 provided individually in a transport lower roller shaft 44*sj* via the transmission gear 120 and transmission belt 138.

Further, the drive from the receive gear 142 rotates a gear 144 with a one-way clutch, the belt 146 with protrusions acting also as the transmission belt, and the take-in roller 56. The drive is transferred to the take-in roller 56 via the gear 144 with a one-way clutch, and therefore, even when the receive gear 142 rotates forward and backward as described previously, the roller 56 rotates only in the solid-line arrow direction in FIG. 4, and shifts only in the direction of the reference surface 57 of the first processing tray 54.

Furthermore, the drive of the transport roller motor 44M is also transferred to a branch lower roller shaft 72*sj* of a branch lower roller 72*b* of the branch rollers 72 that transport the sheet in the branch path 70 via the transmission gear 120 and transmission belt 148.

[Velocity Setting of the Transport Roller Motor]

By the configuration as described above, according to forward/backward rotation of the transport roller motor 44M, the transport rollers 44 and branch rollers 72 rotate in one direction of the solid-line arrow direction shown in the figure and in the other direction (switchback direction) of the dashed-line arrow direction, and the take-in roller rotates in the reference surface 57 direction of the solid-line arrow direction. Further, the transport roller motor 44M is capable of being set arbitrarily to be able to transport a sheet at a velocity of about 1100 mm/s in transporting a sheet to the first processing tray 54 side, and at the velocity of about 1100 mm/s or a velocity of about 600 mm/s lower than the velocity in switchback-transporting to the branch path 70 side. The velocity is a rotation set velocity from startup, the average velocity is lower than the set value, and in any case, the transport velocity is made variable corresponding to the transport direction and sheet length of the sheet, transport mode of wait transport or second tray transport and the like. The velocity setting will be described later.

[Rotation Drive of the Exit Upper Roller]

Drive of the exit rollers 48 comprised of the exit upper roller 48*a* and exit lower roller 48*b* is performed by an exit roller motor 48M. The exit roller motor 48M is also comprised of a hybrid type stepping motor, and a speed detection sensor 48S that detects a rotation speed of the motor shaft is also disposed similarly. Drive of the exit roller motor 48M is transferred to an exit arm gear 156 via transmission gears 150, 152 and transmission belt 154. The drive from the exit arm gear 156 is transferred to an exit upper roller shaft of the exit upper roller 48*a* supported by an exit roller support arm 166 with a transmission belt 158.

[Separate/contact of the Exit Upper Roller, Etc.]

The exit upper roller 48*a* is attached to rotate on the shaft of the exit arm gear 156 so as to separate from and contact the fixed exit lower roller 48*b*. The separate/contact is performed by an exit roller shift arm 160 having a rear sector-shaped gear attached to the shaft of the exit arm gear 156 where a spring 164 to bias the exit upper roller 48*a* is attached to a shift arm point on the front side. By driving to rotate forward and backward an exit roller shift arm motor 160M engaging in the above-mentioned rear sector-shaped gear, the roller shifts in a release direction of the arrow O by rotation in one direction, and shifts in a press-contact direction of the arrow C for coming into press-contact with the exit lower roller 48*b* by rotation in the other direction. In addition, the exit roller shift arm motor 160M is also comprised of a stepping motor, and an exit roller shift arm sensor 160S detects a position of the exit roller shift arm 160.

Further, rotation drive of the exit lower roller 48*b* is performed by transferring drive of the exit roller motor 48M to a receive gear 169 provided individually in an exit lower roller shaft 48*sj* via a transmission gear 150 and transmission belt 168.

[Velocity Setting of the Exit Roller Motor]

By the above-mentioned configuration, according to forward/backward rotation of the exit roller motor 48M, the exit rollers 48 rotate in one direction of the solid-line arrow direction shown in the figure and in the other direction of the dashed-line arrow direction (in the switchback direction to the reference surface 57 on the first processing tray 54 after the sheet is released from the transport rollers 44). Further, the exit roller motor 48M is capable of being set so as to transport a sheet at a velocity of about 1100 mm/s in the case of taking-transporting from the transport rollers 44, at a velocity of about 600 mm/s in the case of switchback transport in the taking reference surface direction, and at a velocity of about 300 mm/s in the case of discharging a bunch of sheets on the first processing tray 54 to the first sheet discharge tray 24 in cooperation with a shift of the reference surface 57. In other words, the exit roller motor 48M is allowed to set the velocity in the range of about 1100 mm/s to about 300 mm/s.

In addition, in this Embodiment, in transporting the sheet with the transport rollers 44 such as the time of switchback transport in the case of performing wait transport, since the drive motors are separate and conjunction is difficult, the exit upper roller 48*a* is positioned in a separate position where the roller is released from the exit lower roller 48*b*.

[Up-and-down of the First Sheet Discharge Tray]

The mechanism of up-and-down of the first sheet discharge tray 24 has already been described in FIG. 3, and setting of the up-and-down position will be described with reference to FIG. 5. The setting of the up-and-down position is performed by detecting the paper surface or upper surface of the first sheet discharge tray 24 by the paper surface sensor 24S, and the paper surface sensor 24S detects a sensor flag 24*f* with one end axially supported rotatably. Further, on the first sheet discharge tray 24 placement surface is provided an empty sensor 25 for detecting whether or not a sheet is placed. Accordingly, when the empty sensor 25 is ON, the paper surface sensor 24S detects the sheet upper surface. When the sensor 25 is OFF, the sensor 24S detects a height of the placement surface without the sheet being placed.

[Up-and-down Position Setting of the First Sheet Discharge Tray]

Figure 5:
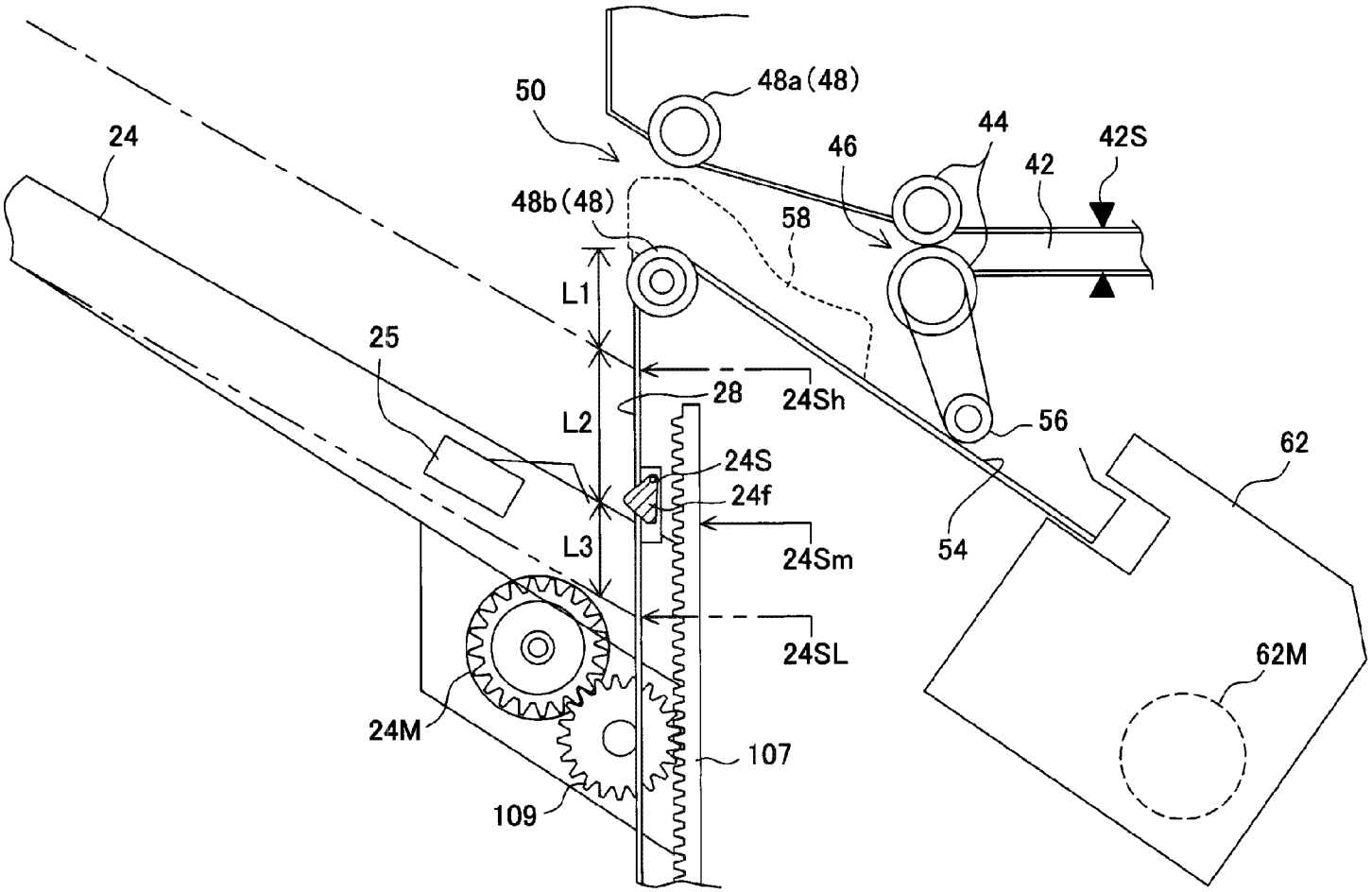
FIG. 5 is an explanatory view of an up-and-down mechanism and up-and-down halt positions of a first sheet discharge tray.

In addition, when a bunch of sheets is discharged from the first processing tray 54, the up-and-down position of the first sheet discharge tray 24 is set so that the placement surface or the paper surface is positioned in 24Sm position with a distance L1+L2 shown in FIG. 5. Further, when sheets are discharged on a sheet-by-sheet basis, the position is moved up and set so that the placement surface or the paper surface is positioned in 24Sh position with a distance L1 so as to shorten a drop range of the sheet. Furthermore, in the case where the sheet undergoing switchback transport by the transport rollers 44 is short or in the case of switchback transport to cause the sheet to wait in the branch path 70 for end-face stitching, the position is moved down and set at 24SL position with a distance L1+L2+L3 so that the front end of the sheet undergoing switchback does not contact the sheet placed on the first sheet discharge tray 24 and placement bench.

Moreover, in the case where the sheet undergoing switchback transport by the transport rollers 44 is long or in the case of switchback transport to transport to the branch path for saddle stitching, in order to guide so as to suppress bending and fluttering of the sheet front end undergoing switchback transport, upward setting is also performed so that the placement surface or the paper surface is positioned in 24Sh position with the distance L1 to shorten the height difference range. This respect will be described later as Embodiment 3.

Herein, the wait transport will be described where the sheet undergoes switchback transport for end-face stitching and waits in the branch path 70 as described above. In the case of performing the binding processing with the end-face stitching unit 62 in the first processing tray 54, there is a need to prevent a next sheet from being carried in before end-face stitching processing of a preceding bunch of sheets is not completed, because the velocity at which the sheet with the image formed in the image formation apparatus A is carried in is fast, and the sheet interval is short. Therefore, a first sheet or sheets up to a second sheet transported to the transport path 42 via the carry-in path 32 are switchback-transported once on the transport path 42, and the switchback-transported sheets are made to stay and wait in the branch path 70. Then, the interval time between bunches of sheets is secured by feeding out the sheet (s) waiting in the branch path 70 to overlap the next second or third sheet to feed (which is disclosed in FIGS. 10A and 10B of the Patent Gazette No. 5248785 as Cited Document 1).

In addition, in the present invention, it is defined as "wait transport" that a sheet is switchback-transported from the transport path 42 to the branch path 70, and that one or more sheets are made to stay and wait in the branch path 70, and are fed and transported together with the next sheet of the waiting sheet. Sheets for end-face stitching to perform the wait transport are usually sheets with relatively short lengths in the transport direction e.g. sheets of each size of A4, B5 and letter. Accordingly, switchback transport for the wait transport of these sheets is performed without significantly protruding to the downstream side of the first processing tray 54, and the sheet is hardly bent at the time of this transport. Even when the sheet is bent slightly, the distance to the first processing tray 54 is relatively short, and therefore, the bending is easy to correct by alignment operation of the alignment plates 58.

Further, the completion of the end-face stitching processing includes not only that operation for discharging a bunch of sheets from the first processing tray 54 to the first sheet discharge tray 24 is completed, but also initial setting operation of the alignment plates 58 on the first processing tray 54, initial position return of the reference surface shift belt 64, and initial position setting of each mechanism to receive the next sheet.

Described next is the case of performing saddle stitching with the saddle stitching unit 82 and transporting the sheets to the stacker 84 that is the second processing tray so as to perform folding processing with the folding rollers 92 and folding blade 94 and make the folded bunch of sheets. To transport to the stacker 84, the sheet transported to the transport path 42 via the carry-in path 32 is once switchback-transported on the transport path 42, and the switchback-transported sheet is transported from the branch path 70 to the stacker 84.

Herein, it is defined as "second tray transport" that the switchback-transported sheet is transported to the stacker 84 via the branch path 70. Sheets for saddle stitching to perform the second tray transport are usually sheets with relatively long lengths in the transport direction to bend in two e.g. sheets of each size of A3, B4 and legal. Accordingly, these sheets significantly protrude to the downstream side of the first processing tray 54 in switchback transport for the second tray transport, and bending or fluttering occurs in the switchback transport. Further, in the second tray transport, since a transport distance to the stacker 84 is relatively long, bending is increased, and is sometimes not corrected even when the saddle stitching alignment plate 81 aligns.

In recent years, sheets have been transported at considerably high velocity with speedup of the image formation apparatus A, particularly significant productivity is required for end-face stitching, and therefore, in applying the velocity to the second tray transport, bending and fluttering of the sheet is increased. Accordingly, in the invention, the velocity of switchback transport in the second tray transport is made lower than the velocity of switchback transport in the wait transport, and it is intended to suppress bending and fluttering of the sheet in the second tray transport.

The respect of a difference in the velocity in switchback transport on the transport path 42 between the wait transport and the second tray transport as described above will be described with reference to sheet flow views from FIGS. 6A to 10B and flowchart diagram of FIG. 11.

[Wait Transport for End-face Stitching]

First, referring to FIGS. 6A to 8B, the wait transport will be described where the transport rollers 44 are rotated backward to cause a sheet to wait in the branch path 70 and then, the sheet is transported to the first processing tray 54 side again so as to collect in the first processing tray 54 to perform end-face stitching on a bunch of sheets.

Figure 6A:
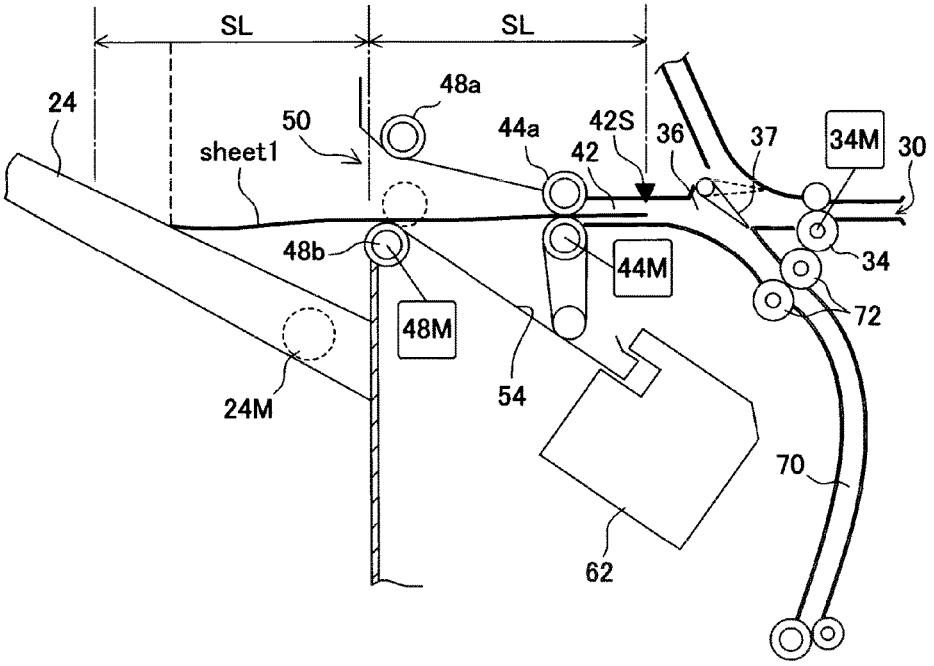
FIGS. 6A and 6B contain explanatory views of wait transport operation of a sheet to store in a first processing tray, where

In FIGS. 6A to 8B, using the case of A4 horizontal that is used relatively frequently in end-face stitching as an example, SL represents a distance from the sheet sensor 42S of the transport path 42 to the exit position (first processing tray exit 50) of the exit roller 48. In this Embodiment, SL is set at 120 mm to 130 mm. Accordingly, the sheet has a length less than twice the SL, and as shown in FIG. 6A, is in a state in which about the half or less protrudes outside the apparatus.

First, in FIG. 6A, a first sheet (sheet 1) to perform end-face stitching is transported on the transport path at about 1100 m/s. When the sheet sensor 42S detects the sheet rear end, the transport rollers 44 are once halted, and then, the transport roller motor 44M is switched to backward rotation to transport the sheet backward. At this point, as described above, the front end side of the sheet is in a state in which almost the half protrudes.

Figure 6B:
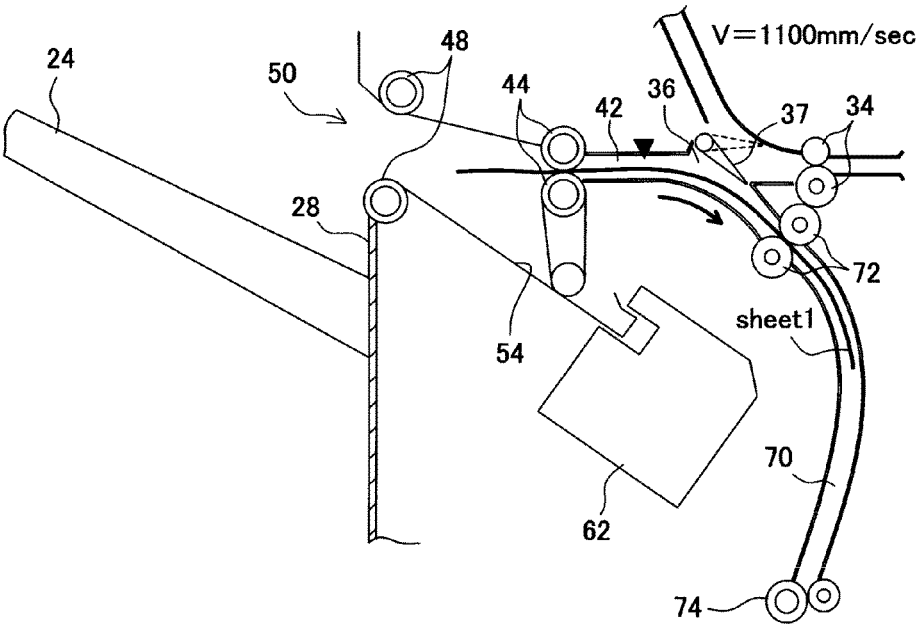

Next, as shown in FIG. 6B, prior to backward rotation of the transport roller motor 44M, the switch gate 37 shifts to the solid-line position shown in the figure. The sheet is transported to the branch path 70 side by the transport rollers 44, and is transported toward the downstream side on the branch path 70 by the branch rollers 72 rotating by the transport roller motor 44M. The transport velocity of the transport roller motor 44M at this time is also set at a high velocity so as to transport the sheet at a velocity of 1100 mm/s. As a matter of course, since the transport roller motor 44M is once halted in switching from forward rotation to backward rotation, the velocity of 1100 mm/s is set as a transport target velocity, and although the average velocity is slightly lower, high-velocity transport is performed to be in time for sheet carry-in from the image formation apparatus.

Figure 7A:
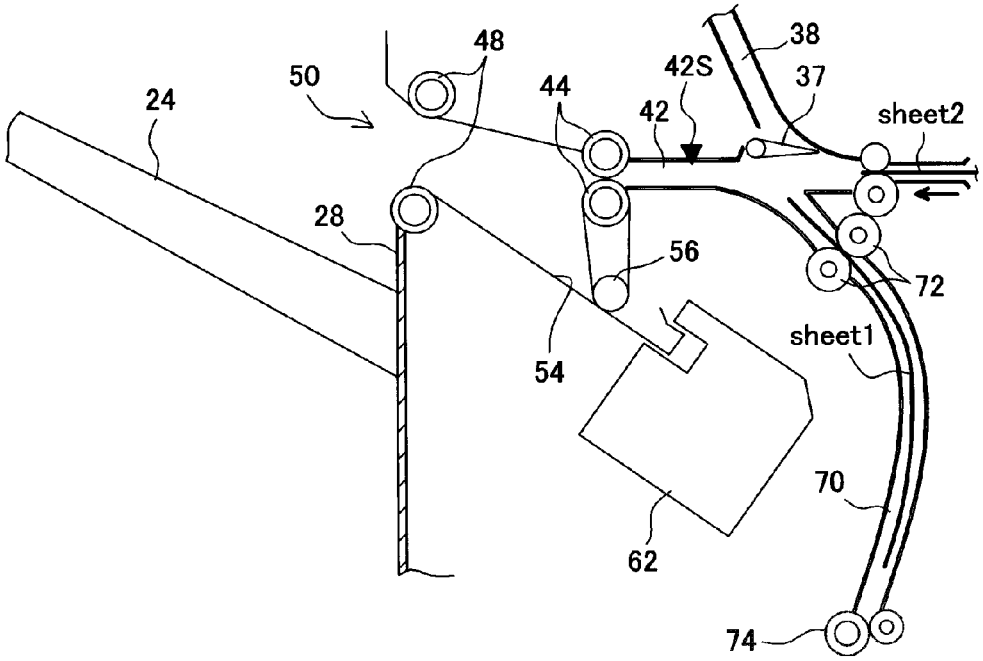
FIGS. 7A and 7B contain explanatory views of wait transport operation continued from FIGS. 6A and 6B, where

In FIG. 7A, when the rear end of the preceding sheet (sheet 1) subjected to switchback transport arrives at a position for not interfering with carry-in of the next sheet (sheet 2) in the branch position 36, the transport roller motor 44M is halted. By this means, the branch rollers 72 are also halted, and the preceding sheet waits in the branch path 70 to wait for carry-in of the next sheet. The next sheet (sheet 2) is transported from the carry-in path 32 toward the transport path 42 at 1100 mm/s by the carry-in roller motor 34M.

Figure 7B:
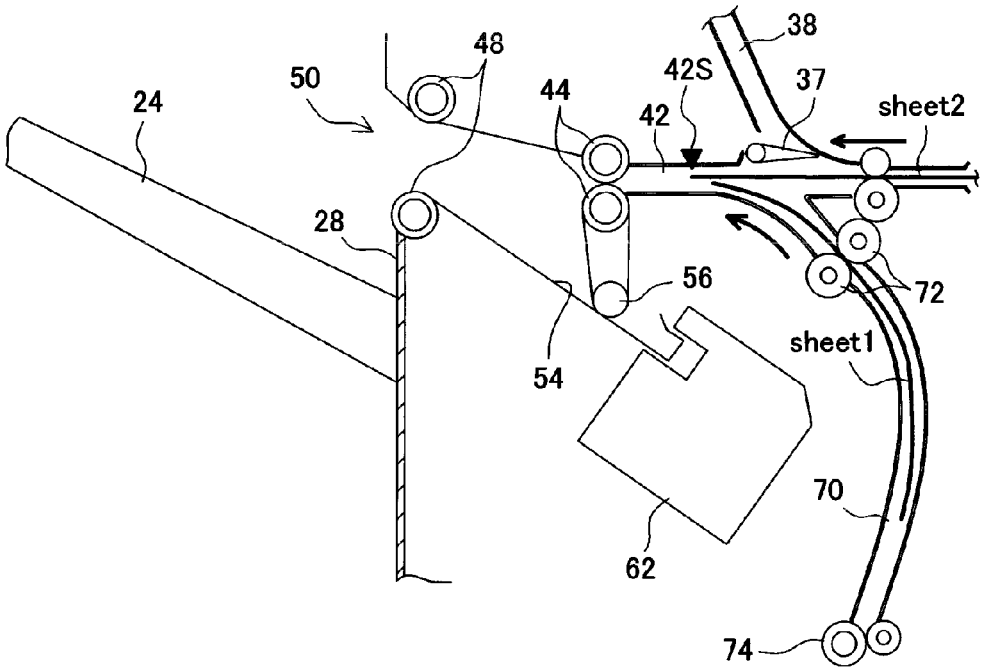

Successively, in FIG. 7B, prior to arrival of the next sheet at the transport path 42, the switch gate 37 is shifted to a position for blocking the escape path as shown in the figure. By this means, the next sheet (sheet 2) is transported to the transport path 42. The sheet is transported so as to enable the sheet to overlap the preceding sheet (sheet 1) waiting in the branch path 70 and be transported. At this point, as shown in the figure, the preceding sheet (sheet 1) is transported, while shifting slightly to the rear side with respect to the front end of the next sheet (sheet 2). As shown next, due to the fact that the uppermost sheet (sheet close to the take-in roller 56) in carrying in the first processing tray 54 is positioned away from the reference surface 57, a plurality of sheets is aligned in the reference surface 57 with accuracy by rotation of the take-in roller 56.

In addition, in overlapping these two sheets one another, both the carry-in roller motor 34M and the transport roller motor 44M are set to transport the sheets at the same velocity with 1100 mm/s as the transport attainment velocity.

Figure 8A:
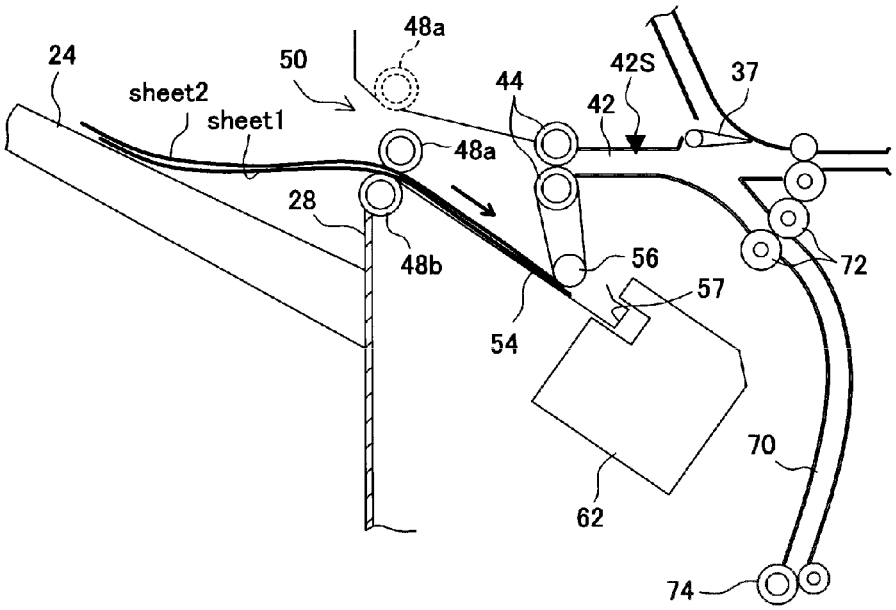
FIGS. 8A and 8B contain explanatory views of wait transport operation continued from FIGS. 7A and 7B, where

Next, the flow proceeds to a state of FIG. 8A, and before two overlapping sheets are released from the transport rollers 44, the exit upper roller 48*a* of the exit rollers 48 moves down toward the exit lower roller 48*b* to nip the sheets. At this point, the exit rollers 48 transport at the same velocity as that of the transport rollers 44, and when the sheets are released from the transport rollers 44, are once halted. After the halt, at this point, the exit rollers 48 are driven to rotate to the reference surface 57 side of the first processing tray 54. By this means, two sheets (sheets 1 and 2) are transported to the reference surface 57 side on the placement surface of the first processing tray 54, and successively, are transported by the take-in roller 56 driven by the transport roller motor 44M via the gear 144 with a one-way clutch. In addition, with respect to transport to the reference surface 57 side by the exit rollers 48, by decreasing the velocity from rotation of 1100 mm/s to about 600 mm/s to transport, alignment is made easier.

Figure 8B:
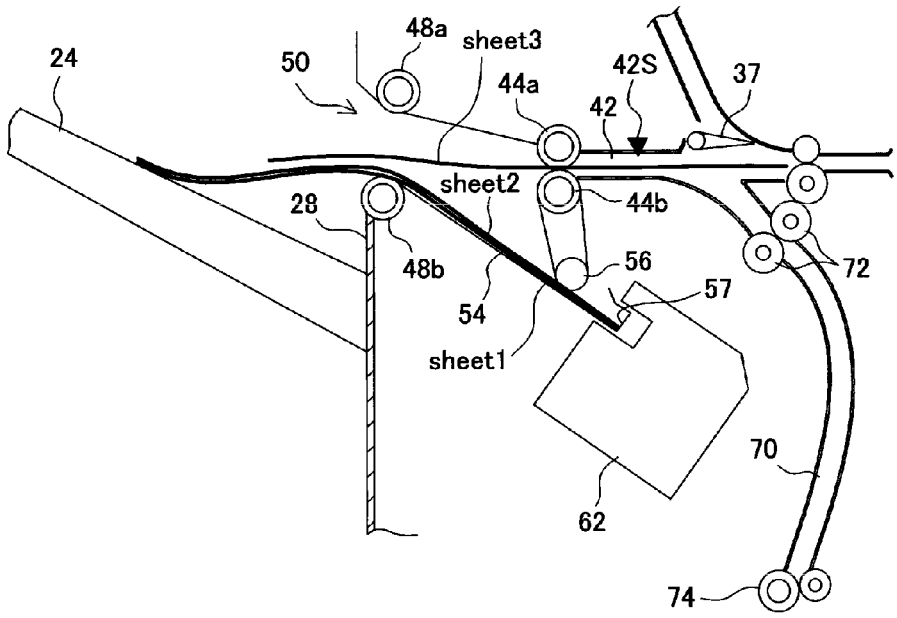

FIG. 8B illustrates a state in which a third sheet (sheet 3) is carried in the first processing tray 54. Also in this case, as in the above-mentioned case, before the third sheet is released from the transport rollers 44, the exit upper roller 48*a* is moved down to rotate in the same direction as in the transport rollers 44, and after the sheet is released, the rotation direction is reversed this time to carry to the reference surface 57 side together with the take-in roller 56. This operation is repeated up to the designated number of sheets to create a single bunch, and after performing the binding processing with the end-face stitching unit 62, the bunch of sheets is discharged to the first sheet discharge tray 24.

As described above, in the wait transport for end-face stitching in FIGS. 6A to 8B, the switchback transport velocity of the transport rollers 44 is set at 1100 mm/s as the set velocity to perform high-velocity transport.

[Second Tray Transport for Saddle Stitching]

Referring to FIGS. 9A to 10B, described next is the "second tray transport" for rotating the transport rollers 44 backward to feed to the stacker via the branch path 70, in order to collect sheets in the stacker (second processing tray) as the second tray to perform saddle stitching on the middle portion in the sheet transport direction of a bunch of sheets.

Figure 9A:
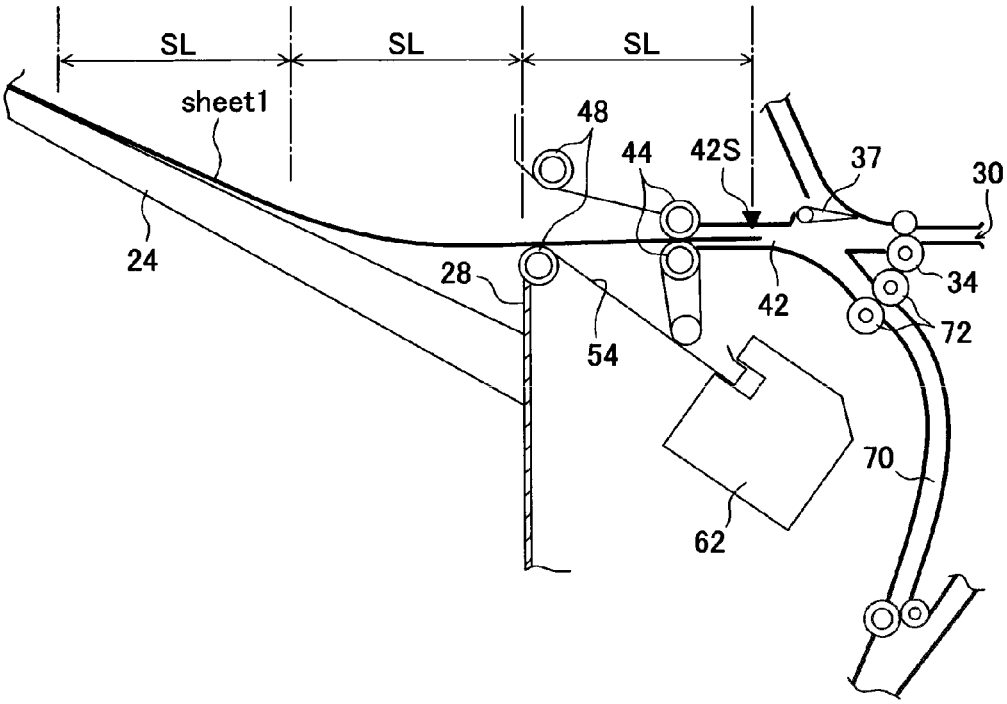
FIGS. 9A and 9B contain explanatory views of second tray transport operation to store a sheet in a stacker (second processing tray) for saddle stitching processing, where

In FIGS. 9A to 10B, using the case of an A3-sheet that is used relatively frequently in saddle stitching as an example, as in the previous end-face stitching, SL represents a distance from the sheet sensor 42S of the transport path 42 to the exit position (first processing tray exit 50) of the exit roller 48. In this Embodiment, SL is 120 mm to 130 mm, and the sheet for saddle stitching has a length about 3.5 times the SL, and as shown in FIG. 9A, is in a state in which about two-thirds or more protrudes outside the apparatus.

First, FIG. 9A illustrates that the second tray transport is performed to feed to the stacker 84 via the branch path 70 so as to perform saddle stitching, where a first sheet (sheet 1) is transported on the transport path 42 at about 1100 m/s. When the sheet sensor 42S detects the sheet rear end, the transport rollers 44 are once halted, and then, the transport roller motor 44M is switched to backward rotation so as to transport the sheet backward. At this point, as described above, the front end side of the sheet is in a state in which almost two-thirds or more protrudes outside the apparatus.

Figure 9B:
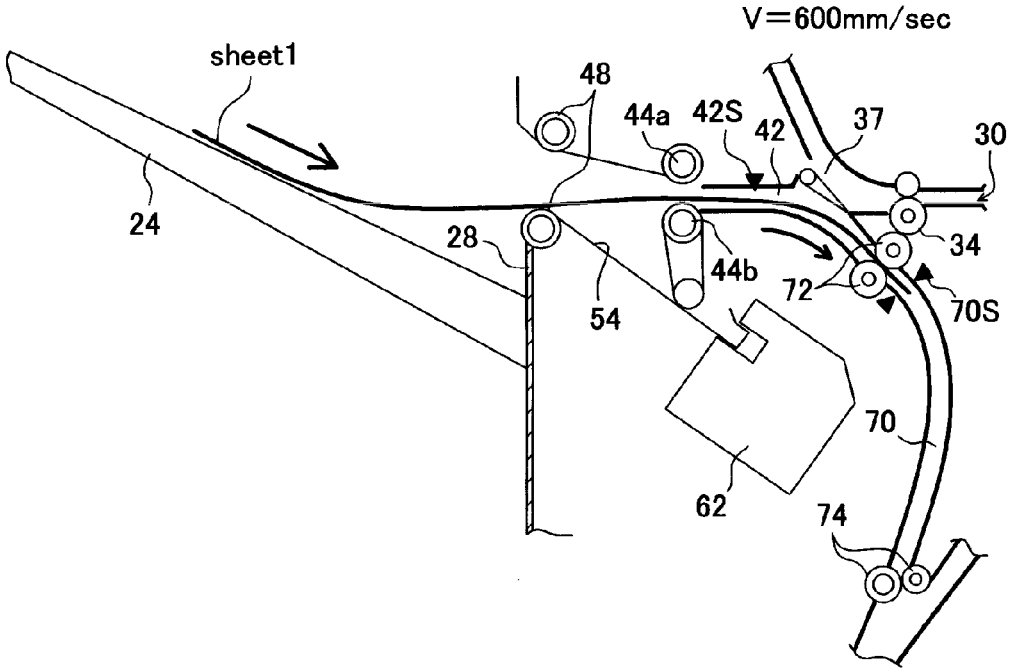

Next, as shown in FIG. 9B, prior to backward rotation of the transport roller motor 44M, the switch gate 37 shifts to the position shown in the figure. The sheet is transported to the branch path 70 side by the transport rollers 44, and is transported toward the downstream side of the branch path 70 by the branch rollers 72 rotating by the transport roller motor 44M. The transport velocity of the transport roller motor 44M at this time is also set to be changed to a low velocity so as to transport the sheet at a velocity of 600 mm/s by reducing the velocity.

Then, when the first sheet (sheet 1) is nipped by the branch rollers 72 rotating at the same velocity of 600 mm/s, the switch gate 37 shifts to the position (position for blocking the escape path) for releasing the transport path 42. Concurrently therewith, the transport upper roller 44*a* of the transport rollers 44 is separated from the transport lower roller 44*b* to wait for carry-in of the next sheet (sheet 2).

In addition, since the transport roller motor 44M is once halted in switching from forward rotation to backward rotation, the velocity of 600 mm/s is set as a transport target velocity, and although the average velocity is slightly lower, the velocity is reduced with this velocity as a set value. Further, at the time of switchback transport, the velocity is reduced from 1100 mm/s to 600 mm/s. This is because fluttering of a sheet particularly occurs significantly in switchback transport that is return transport of the sheet and the sheet is transported a relatively long distance, the velocity is reduced particularly in the return. As another Embodiment, when the processing speed does particularly not require high speed, in reciprocating transport for discharging the sheet undergoing switchback outside the apparatus, the velocity may be reduced from 1100 mm/s to 600 mm/s.

Figure 10A:
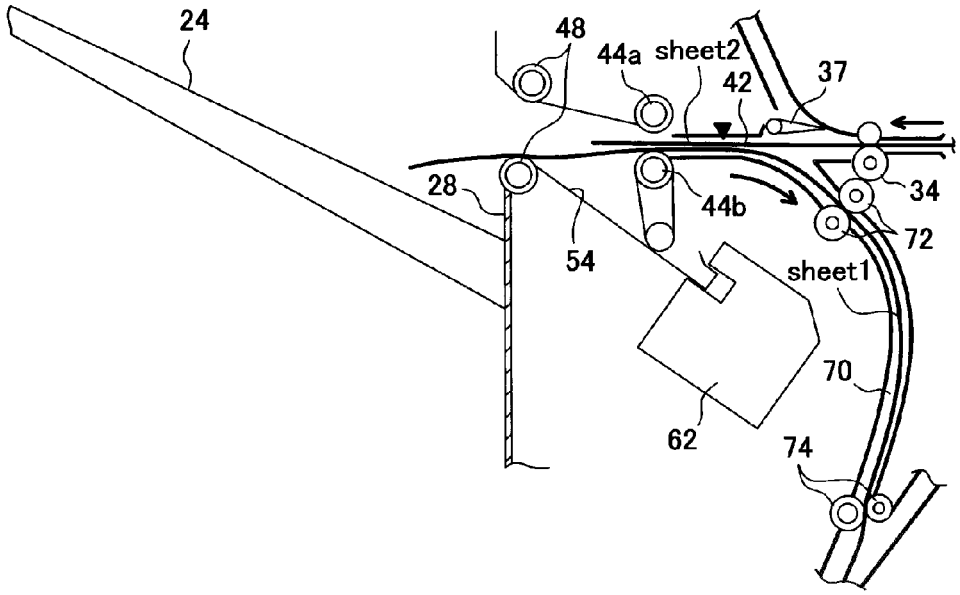
FIGS. 10A and 10B contain explanatory views of second tray transport operation continued from FIGS. 9A and 9B, where

Next, in FIG. 10A, the next sheet (sheet 2) is transported to the transport path 42 by the carry-in roller 34. In this case, since the transport rollers 44 are in a separate state as shown in the figure, the preceding first sheet (sheet 1) is transported to the stacker 84 at 600 mm/s by the branch rollers 72 and branch exit rollers 74, and the next second sheet (sheet 2) is transported on the transport path 42 at 1100 mm/s toward the first processing tray 54 side by the carry-in roller 34. In this case, two sheets are transported (passing-transported) while passing each other in opposite directions.

The passing transport is performed so as to eliminate or reduce the wait time of the next sheet, because the preceding sheet is transported at the reduced velocity.

Figure 10B:
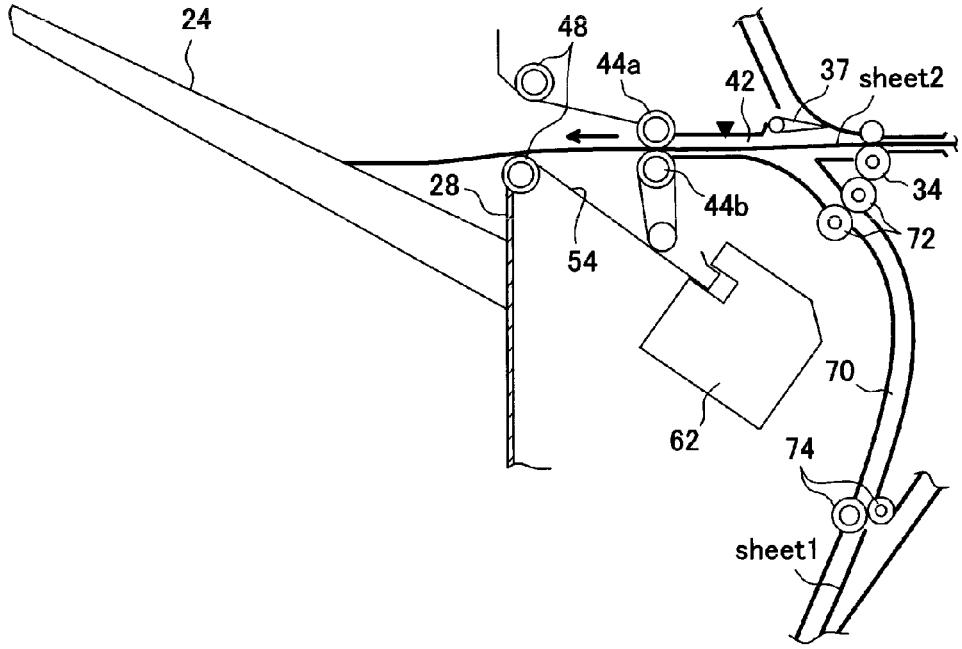

Then, in FIG. 10B, since the preceding sheet is removed from the branch rollers 72 and in a state of being stored in the stacker 84, the transport upper roller 44*a* is moved down to make the transport rollers 44 a nip state, and the sheet is transported at the velocity of 1100 mm/s toward the first sheet discharge tray 24 side. Subsequently, the sheet is transported successively in the state of FIG. 9A, and this operation is repeated up to the designated number of sheets to create a single bunch in the stacker 84. Then, the bunch of sheets is shifted to a binding position of the saddle stitching unit 82 by the stopper 85 shown in FIG. 2 to perform saddle stitching processing.

As described above, in the second tray transport for saddle stitching in FIGS. 9A to 10B, the switchback transport velocity of the transport rollers 44 is set at 600 mm/s as the set velocity to perform low-velocity transport so as to reduce fluttering and bending of the sheet in switchback transport.

Figure 11:
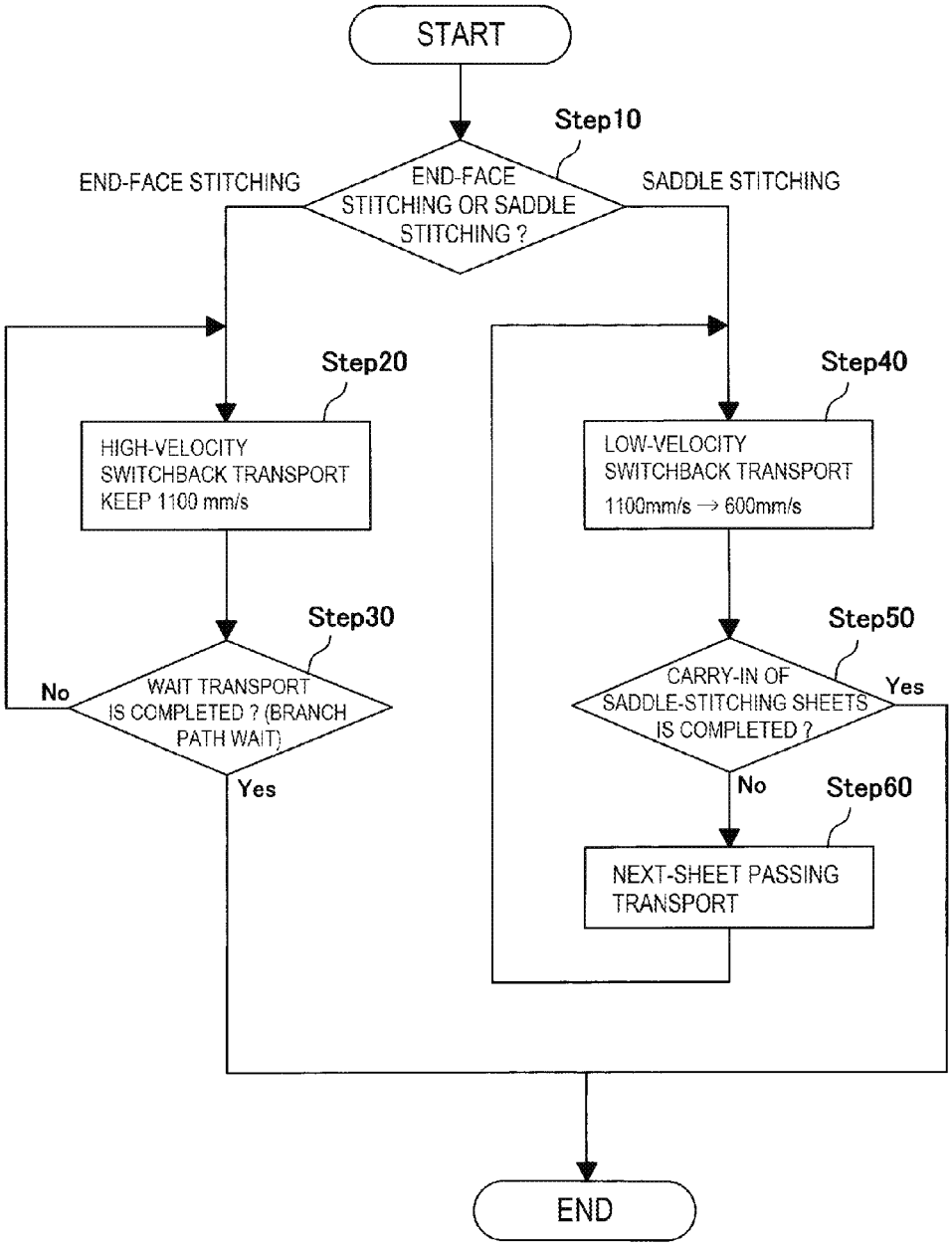
FIG. 11 is a flow explanatory diagram for changing switchback velocity corresponding to end-face stitching or saddle stitching.

Herein, the wait transport of FIGS. 6A to 8B and transport velocity switch in FIGS. 9A to 10B described in the forgoing will be confirmed with reference to a flow diagram of FIG. 11. Further, another Embodiment different from the Embodiment described in the foregoing will be described with reference to FIG. 12.

[Velocity Reduction in Switchback Velocity Corresponding to End-face Stitching or Saddle Stitching]

First, as shown in FIG. 11, when an "end-face stitching mode" or "saddle stitching mode" is set from the control panel 18 of the image formation section 2, the mode is confirmed (Step 10). When the mode is end-face stitching, since sheets with relatively short lengths are usually used, the velocity of switchback transport is kept at 1100 mm/s to perform (Step 20). By this means, for example, a sheet or sheets up to three sheets are once switchback-transported to wait (branch path wait) in the branch path 70, and are switchback-transported again to the first processing tray 54 side together with a subsequent sheet.

When the wait transport is completed, the step is finished, and the flow shifts to the next step.

Next, when saddle stitching is confirmed (Step 10), it is assumed that sheets with relatively long lengths are usually used, and as described in FIGS. 9A and 9B, the switchback transport velocity by the transport rollers 44 is reduced from 1100 mm/s to 600 mm/s to perform switchback transport (Step 40). The presence or absence of a subsequent sheet to carry in the stacker 84 to be a bunch is checked (Step 50). When the step is not completed and there is the subsequent sheet to be a bunch, the passing transport as shown in FIG. 10B is executed. When there is not the subsequent sheet to be a bunch, the processing of the second tray transport is completed, and the flow shifts to the next step such as saddle stitching.

[Embodiment 2•••Velocity Change while Checking the Sheet Size in End-face Stitching and Saddle Stitching]

A Modification of the Embodiment as described above will be described next with reference to a flow diagram of FIG. 12.

In the Embodiment up to FIG. 11 in the foregoing, corresponding to whether the binding mode is end-face stitching for binding end faces of a bunch of sheets on the first processing tray 54 or saddle stitching for binding a bunch of sheets collected in the stacker 84, it is selected performing while uniformly keeping the velocity of switchback transport at 1100 mm/s or performing while reducing the velocity from 1100 mm/s to 600 mm/s. This manner enables almost the processing to be covered, but there are sheets with long transport distances even in end-face stitching. On the other hand, even in saddle stitching, the case occurs where relatively short sheets are processed.

Figure 12:
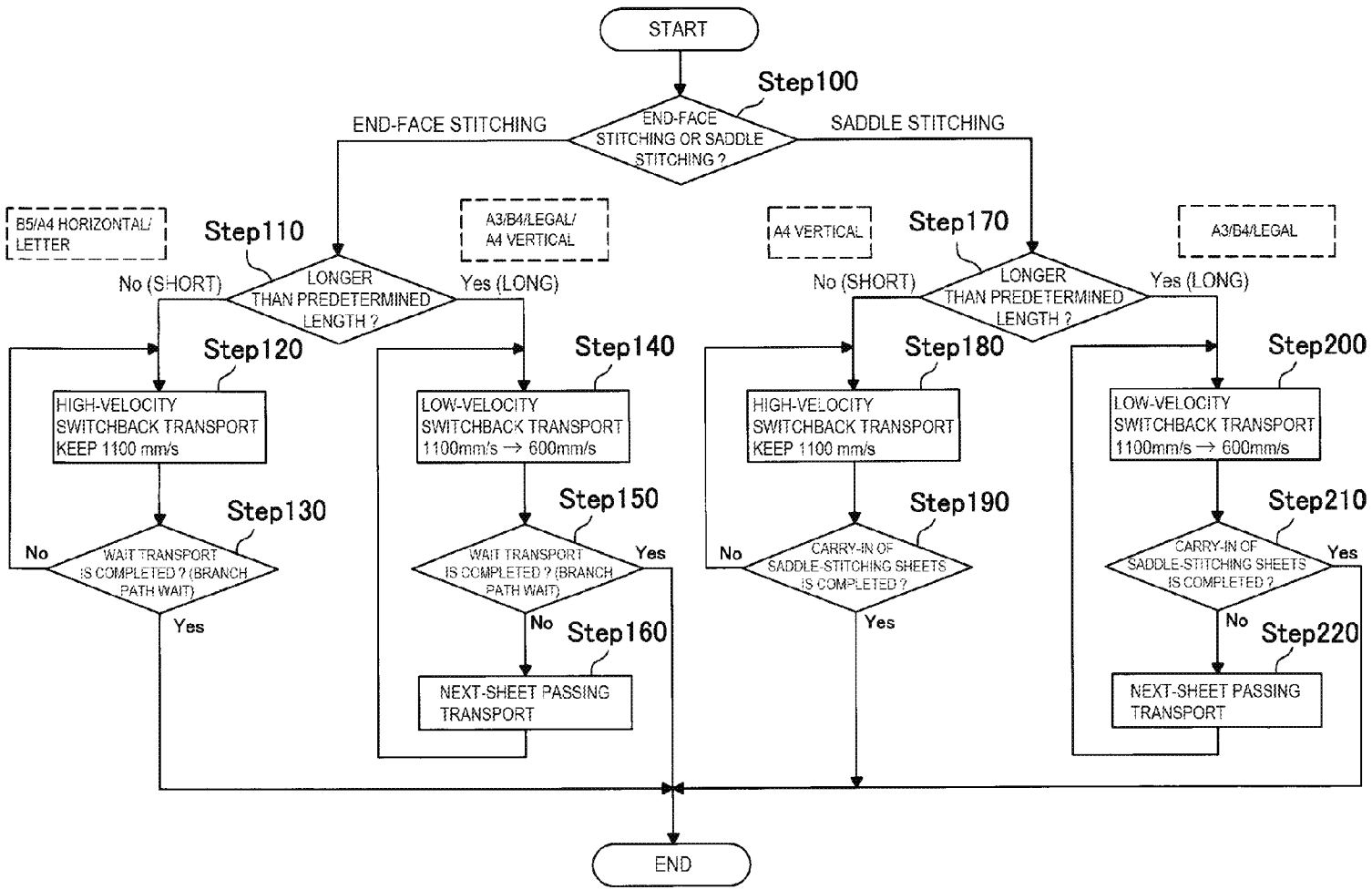
FIG. 12 is Modification (Embodiment 2) of FIG. 11, and is a flow explanatory diagram for checking a sheet size in each of end-face stitching and saddle stitching to change velocity.

By adopting the flow in FIG. 12, it is intended to stably feed relatively long sheets of the time of end-face stitching or relatively short sheets of the time of saddle stitching.

[Velocity Change Corresponding to the Sheet Size in End-face Stitching]

In other words, when the "end-face stitching mode" or "saddle stitching mode" is set from the control panel 18 of the image formation section 2, the mode is confirmed (Step 100). When the mode is end-face stitching, the flow proceeds to the left side as viewed in the figure, and it is checked whether or not the length of the sheet to perform end-face stitching is longer than a predetermined length (Step 110). In this Modification, the case where the sheet size is B5, A4 horizontal or letter is set for short, and the case of exceeding the size e.g. lengths of A3, B4, legal and A4 vertical are set for long. Then, in the case of short, the processing is performed, while keeping the velocity of switchback transport at 1100 mm/s (Step 120). By this means, for example, a sheet or sheets up to three sheets are once switchback-transported to wait (branch path wait) in the branch path 70, and are switchback-transported again to the first processing tray 54 side. When the wait transport is completed, the step is finished, and the flow shifts to the next step.

In addition, identification of the sheet size in this Modification is set by obtaining size information from the image formation control section 200. Alternatively, a sensor for size detection may be disposed near the carry-in entrance 30 of the sheet processing apparatus B to detect.

On the other hand, when the sheet length is regarded as being long in the above-mentioned step, the switchback transport velocity by the transport rollers 44 is reduced from 1100 mm/s to 600 mm/s to perform switchback transport (Step 140). In this case, when the wait transport is performed together with a subsequent sheet, it is checked that the preceding sheet is nipped by the branch rollers 72, and then, the passing transport with the next sheet is performed (Step 160). When the wait transport is completed, the step is finished, and the flow shifts to the next step.

[Velocity Change Corresponding to the Sheet Size in Saddle Stitching]

The "end-face stitching mode" or "saddle stitching mode" is set, and in the case of saddle stitching, the flow proceeds to the right side as viewed in the figure to check whether or not the length of the sheet to perform saddle stitching is longer than a predetermined length (Step 170). In this Modification, the case where the sheet size is A4 vertical is set for short, and for example, the case of A3, B4 and legal is set for long. Herein, A4 vertical that is set for long in end-face stitching is set for short in the saddle stitching on purpose. This is because the A4 vertical size in saddle stitching is sorted to short sheets among sheet lengths to perform saddle stitching, and is relatively easy to obtain high-speed processing. Further, since the branch rollers 72 rotate without halting for forward and backward rotation, alignment characteristics do not deteriorate so much, and therefore, the criterion is changed from end-face stitching.

In the case where the sheet length of sheets for saddle stitching is short, in this Modification, in the case of A4 vertical, the velocity of switchback transport is kept at 1100 mm/s to perform (Step 180). By this means, when it is judged that carry-in of sheets for saddle stitching in the stacker 84 is completed (Step 190), the second tray transport is regarded as being completed, and the flow shifts to the next step.

When the sheet length is regarded as being long in the foregoing, the switchback transport velocity by the transport rollers 44 is reduced from 1100 mm/s to 600 mm/s to perform switchback transport (Step 200). In this case, it is confirmed that the second tray transport is performed together with a subsequent sheet (Step 210), and after the preceding sheet is nipped by the branch rollers 72, the passing transport with the next sheet is performed (Step 220). When there is not a subsequent sheet to be a bunch, the processing of the second tray transport is completed, and the flow shifts to the next step such as saddle stitching.

As described above, in the above-mentioned Modification, instead of changing the velocity of switchback transport by the transport rollers 44 corresponding to end-face stitching or saddle stitching, in any one of end-face stitching and saddle stitching, the sheet length is checked to change the switchback velocity. Further, for example, in the same length of A4 vertical in end-face stitching and A4 vertical in saddle stitching, the most suitable switchback velocity is set to ensure compatibility between stable transport and speedup.

[Description of a Control Configuration]

A system control configuration of the above-mentioned image formation apparatus will be described according to a block diagram of FIG. 13. A system of the image formation apparatus as shown in FIG. 1 is provided with the image formation control section 200 of the image formation apparatus A and a sheet processing control section 204 (control CPU) of the sheet processing apparatus B. The image formation control section 200 is provided with a paper feed control section 202 and input section 203. Then, as described previously, the setting of the "print mode" and "sheet processing mode" is performed from the control panel 18 provided in the input section 203.

The sheet processing control section 204 is the control CPU for operating the sheet processing apparatus B corresponding to the designated sheet processing mode described previously. The sheet processing control section 204 is provided with ROM 206 for storing operation programs and RAM 207 for storing control data. Further, to the sheet processing control section 204 are input signals from a various-sensor input section of a carry-in sensor 30S for detecting a sheet in the carry-in path 32, sheet sensor 42S for detecting a sheet in the transport path 42, branch sensor 70S for detecting a sheet in the branch path 70, paper surface sensor 24S for detecting a paper surface on the first sheet discharge tray 24 and the like The sheet processing control section 204 is provided with a sheet transport control section 210 that controls the carry-in roller motor 32M of the carry-in path 32 of a sheet, the transport roller motor 44M of the transport path 42 and branch path, and the exit roller motor 48M of the first processing tray 54 exit. Further, the sheet processing control section 204 is provided with a punch drive control section 211 that controls a punch motor 31M for performing punching processing on a sheet in the punch unit 31, and a processing tray (first processing tray 54) control section 212 that controls the alignment plates 58 for performing collection operation of sheets in the first processing tray 54. Furthermore, the section is also provided with an end-face stitching control section 213 that controls an end-face stitching motor 62M of the end-face stitching unit 62 for performing end-face stitching on a bunch of sheets on the first processing tray 54, and a first tray (first sheet discharge tray 24) up-and-down control section 214 that controls the up-and-down motor 24M for moving up and down corresponding to a bunch of sheets subjected to end-face stitching and sheet switchback onto the first sheet discharge tray 24.

Further, the sheet processing control section 204 has a stacker control section 216 that controls the saddle stitching alignment plate 81 of sheets to collect in the stacker 84 that is the second processing tray so as to perform saddle stitching processing and the stopper shift motor 85M of the stopper 85 for regulating the sheet front end, and a saddle stitching control section 217 that controls a saddle stitching motor 82M for binding the middle portion in the transport direction of a bunch of sheets.

Furthermore, the sheet processing control section 204 is also provided with a middle folding•discharge control section 218 that controls the folding rollers, folding blade and discharge motor 92M for folding the saddle-stitched bunch of sheets in two to discharge to the second sheet discharge tray 26.

Connection among each of the above-mentioned control sections, each sensor for detecting the sheet length and each drive motor, and the like are as described already in the aspect of each operation.

[Description of Sheet Processing Modes]

The sheet processing control section 204 of this Embodiment configured as described above causes the sheet processing apparatus B to execute the "print-out mode", "end-face stitching mode", "saddle stitching mode" and the like, for example. The processing modes will be described below.

(1) "Print-out Mode"

The mode is to receive a sheet with an image formed from the main-body discharge outlet 3 of the image formation apparatus A and store the sheet in the first sheet discharge tray 24 using the transport rollers 44 and exit rollers 48.

(2) "End-face Stitching Mode"

The mode is to receive a sheet with an image formed from the main-body discharge outlet 3 in the first processing tray 54, collate sheets in the shape of a bunch, perform binding processing in the end-face stitching unit 62, and then, store in the first sheet discharge tray 24. In addition, in the end-face stitching processing, so as not to halt discharge of a subsequent sheet from the main-body discharge outlet 3, the "wait transport" is sometimes performed where a preceding sheet is switchback-transported and temporarily waits in the branch path 70.

(3) "Saddle Stitching Mode"

The mode is to receive a sheet with an image formed from the main-body discharge outlet 3 of the image formation apparatus A in the stacker 84, collate sheets in the shape of a bunch, bind substantially the center in the receive transport direction of the sheets in the saddle stitching unit 82, fold in the shape of a booklet, and store in the second sheet discharge tray 26.

In addition, in the saddle stitching processing, the "second tray transport" is performed where the sheet from the main-body discharge outlet 3 is once discharged onto the first sheet discharge tray 24, is then switchback-transported to the branch path 70, and is transported to the stacker 84.

Hereinafter, Modifications will be described to perform more stable transport, while suppressing fluttering and catching in switchback transport of the above-mentioned Embodiments. In addition to reduction in the velocity in the switchback transport in the foregoing, Embodiment 3 is to perform a backup guide in the switchback transport by moving the first sheet discharge tray 24 up. Further, Embodiment 4 is to provide auxiliary guides 110 that extend and retract under the first processing tray 54 (first tray), and by this means, perform a backup guide in the switchback transport. Furthermore, Embodiment 4 also describes an apparatus where the first sheet discharge tray 24 is moved up according to extension of the auxiliary guide 110. In addition, in drawings of the Modifications, components similar to the foregoing are represented by adding the same reference numerals.

[Embodiment 3•••Backup Guide by the First Sheet Discharge Tray in the Second Tray Transport]

Referring to FIGS. 14A to 15B, described next is the case where the first sheet discharge tray is moved up to perform backup transport of the switchback sheet, in the "second tray transport" for rotating the transport rollers 44 backward to feed to the stacker via the branch path 70 so as to collect sheets in the stacker 84 and perform saddle stitching in the middle portion in the sheet transport direction of a bunch of sheets. In addition, the switchback sheet performs the same transport operation as in FIGS. 9A to 10B described already.

Figure 14A:
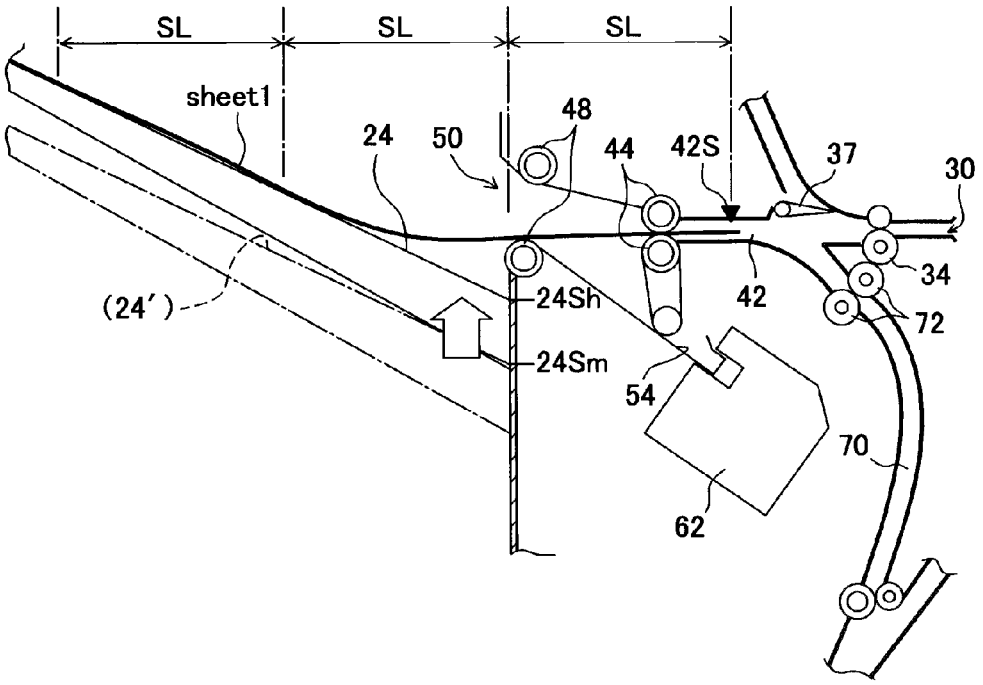
FIGS. 14A and 14B contain explanatory views of Embodiment 3 according to second tray transport operation to store a sheet in the stacker (second processing tray) for saddle stitching and a halt position of the first sheet discharge tray, where

First, FIG. 14A illustrates performing the second tray transport to the stacker 84 via the branch path 70 to perform saddle stitching as in FIG. 9A. At this point, a shift of a switchback sheet to a guide position 24Sh moved up from the sheet receive position 24Sm of the first sheet discharge tray is performed by driving the up-and-down motor 24M in an upward direction from ON of the sensor flag 24*f* shown in FIG. 5, while setting predetermined pulses. By this means, the switchback sheet transported from the first processing tray exit 50 is guided by the first sheet discharge tray 24 placement surface or the sheet loaded on the placement surface, and fluttering and bending is suppressed.

Figure 14B:
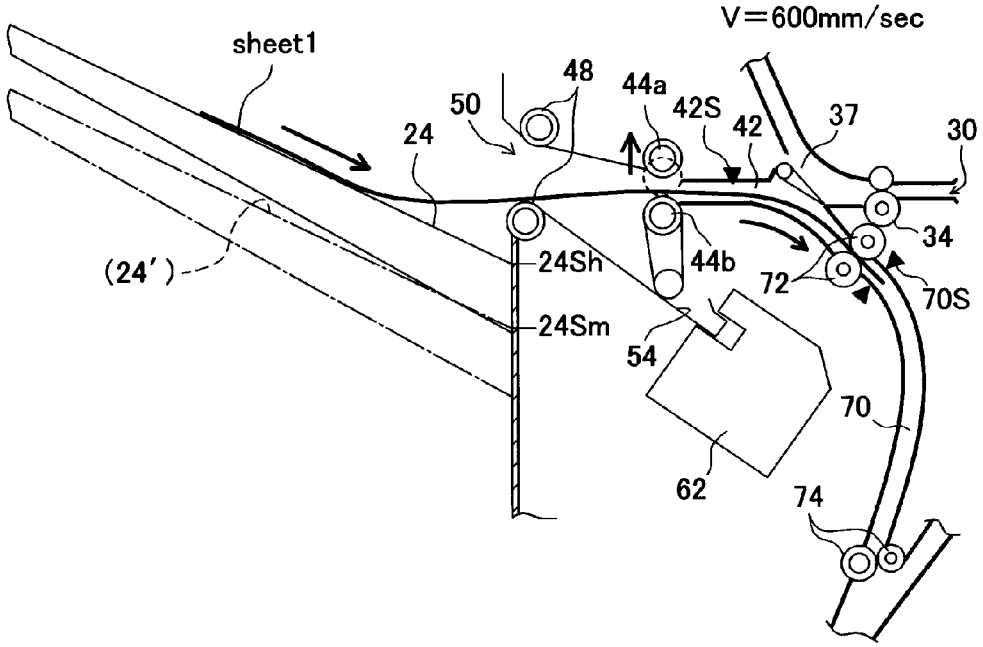

Next, as shown in FIG. 14B, the transport velocity of the transport roller motor 44M is also set to change to a low velocity so as to transport a sheet at a reduced velocity of 600 mm/s. The placement surface of the first sheet discharge tray 24 or the placed sheet upper surface is positioned in the guide position 24Sh that is the solid-line position and guides the sheet to undergo switchback.

Figure 15A:
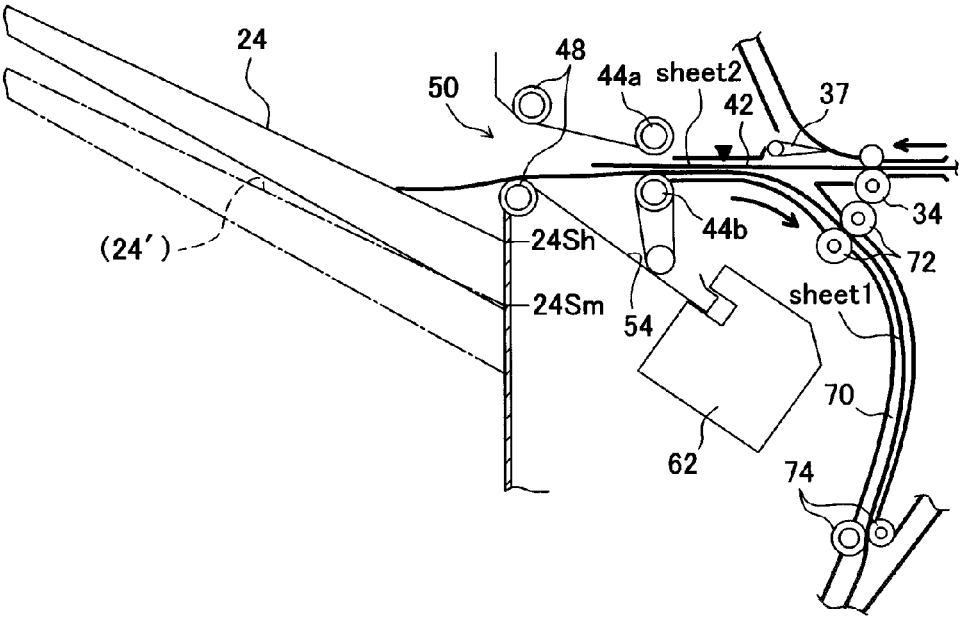
FIGS. 15A and 15B contain second tray transport operation explanatory views continued from FIGS. 14A and 14B, where

Next, in FIG. 15A, the next sheet (sheet 2) is transported to the transport path 42 by the carry-in roller 34, and two sheets are transported (passing-transported) while passing each other in the opposite directions. The placement surface of the first sheet discharge tray 24 or the placed sheet upper surface is also positioned in the guide position 24Sh that is the solid-line position at this point, and guides the sheet to undergo switchback.

Figure 15B:
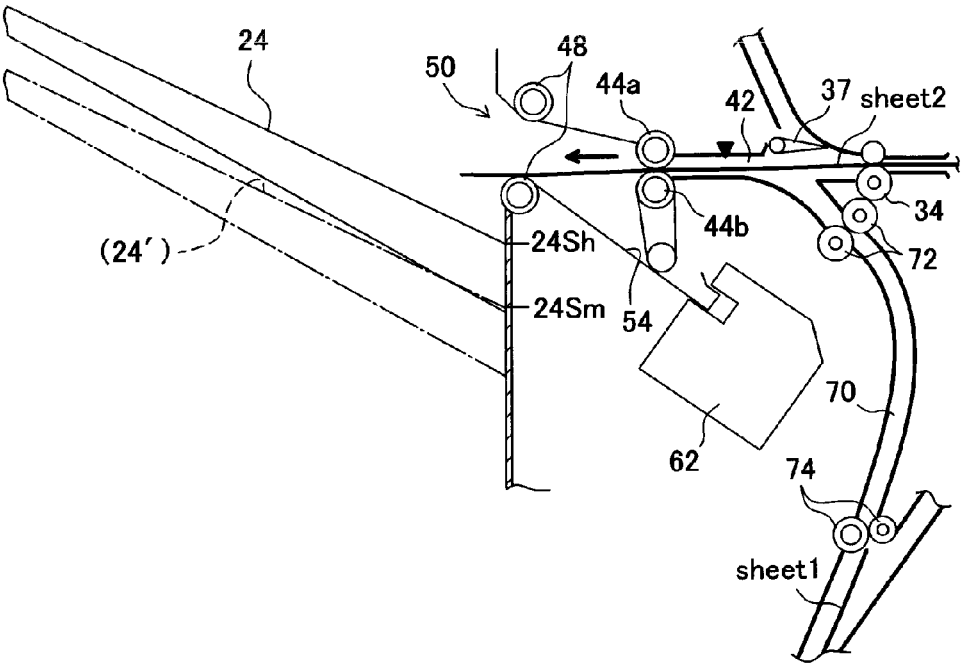

Then, in FIG. 15B, as in FIG. 10B, the next sheet is transported to the first sheet discharge tray 24 side at a velocity of 1100 mm/s. As described above, the placement surface of the first sheet discharge tray 24 or the placed sheet upper surface is positioned in the guide position 24Sh that is the solid-line position, guides the sheet to undergo switchback, and reduces fluttering and bending at the time of switchback transport of the sheet.

Figure 16A:
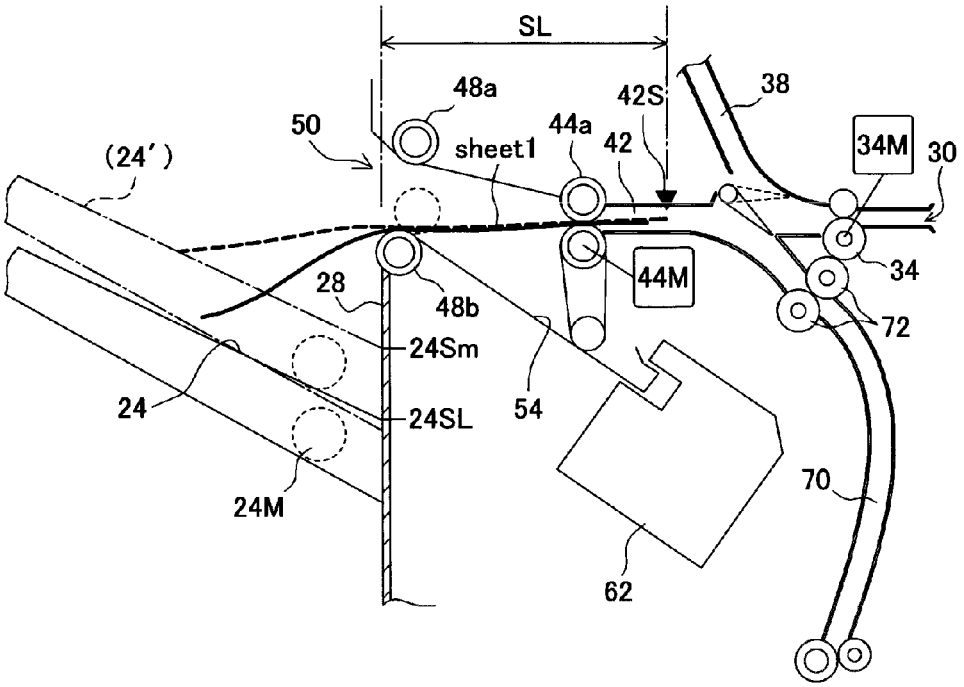
FIGS. 16A and 16B contain explanatory views of Modification of the halt position of the first sheet discharge tray in wait transport of a sheet to store in the first processing tray shown in FIGS. 6A and 6B, where

Herein, another Embodiment (Modification) of the wait transport in end-face stitching in FIGS. 6A to 8B will be described with reference to FIGS. 16A and 16B. FIG. 16A illustrates starting switchback transport by the transport rollers 44 to perform the wait transport as in FIG. 6A. In this case, in FIG. 6A, the placement surface of the first sheet discharge tray 24 or the sheet upper surface on the placement surface is positioned in the sheet receive position Sm. In such a case, since the sheet to undergo switchback is transported at a high velocity, the sheet front end collides with the placement surface or the sheet on the placement surface, and the switchback sheet front end sometimes buckles. To prevent the buckle, as shown in FIG. 16A, the tray is moved down to a separate position 24Sl and positioned so that the front end of the switchback sheet does not collide. By shifting to this position, it is eliminated that the switchback sheet buckles.

In addition, the distance to shift from the sheet receive position Sm to the separate position 24Sl may be adjusted in position so that the sheet front end does not collide, according to the sheet size to perform the wait transport.

Figure 16B:
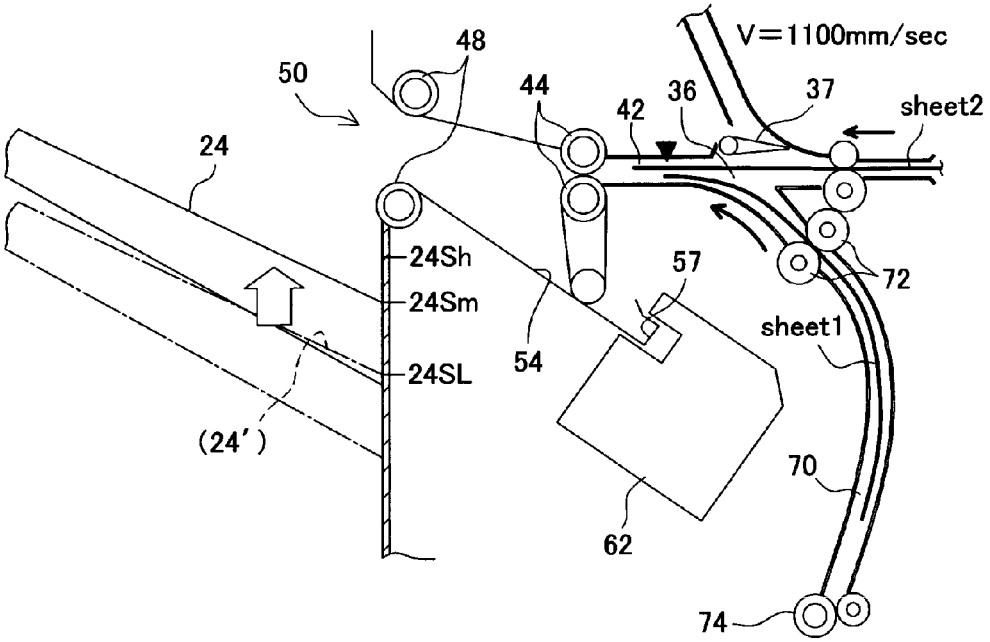

FIG. 16B is a Modification corresponding to FIG. 7B, and illustrates overlapping the preceding sheet waiting in the branch path 70 and the next sheet transported in the carry-in path 32 to discharge to the first sheet processing tray 54. In this state, the placement surface or the sheet upper surface placed on the placement surface in the separate position 24Sl in FIG. 16A is driven in an upward direction by the up-and-down motor 24M, and is positioned upward in the sheet receive position 24Sm. By this means, the sheet transported from the first processing tray exit 50 is supported across the first processing tray 54, and transfer to the reference surface 57 side is performed smoothly.

As described above, in this Modification, even in high-velocity transport of the wait transport, it is possible to prevent the sheet front end from buckling, and by placing the sheet across the first sheet discharge tray 24 and first processing tray 54, it is possible to carry the sheet to the reference surface 57 side smoothly.

[Embodiment 4•••Backup Guide by Extension of the Auxiliary Guide in the Second Tray Transport]

Next, referring to FIGS. 17 to 24, it will be described that the auxiliary guide 110 is extended above the first sheet discharge tray 24 to backup-transport a switchback sheet at the time of "second tray transport" for rotating the transport rollers 44 backward to feed to the stacker via the branch path 70, while collecting sheets in the stacker 84 to perform saddle stitching in the middle portion in the sheet transport direction of a bunch of sheets. In addition, the sheet to undergo switchback transport performs the same operation as in FIGS. 9A to 10B already described.

[In Regard to the Auxiliary Guide]

Figure 17:
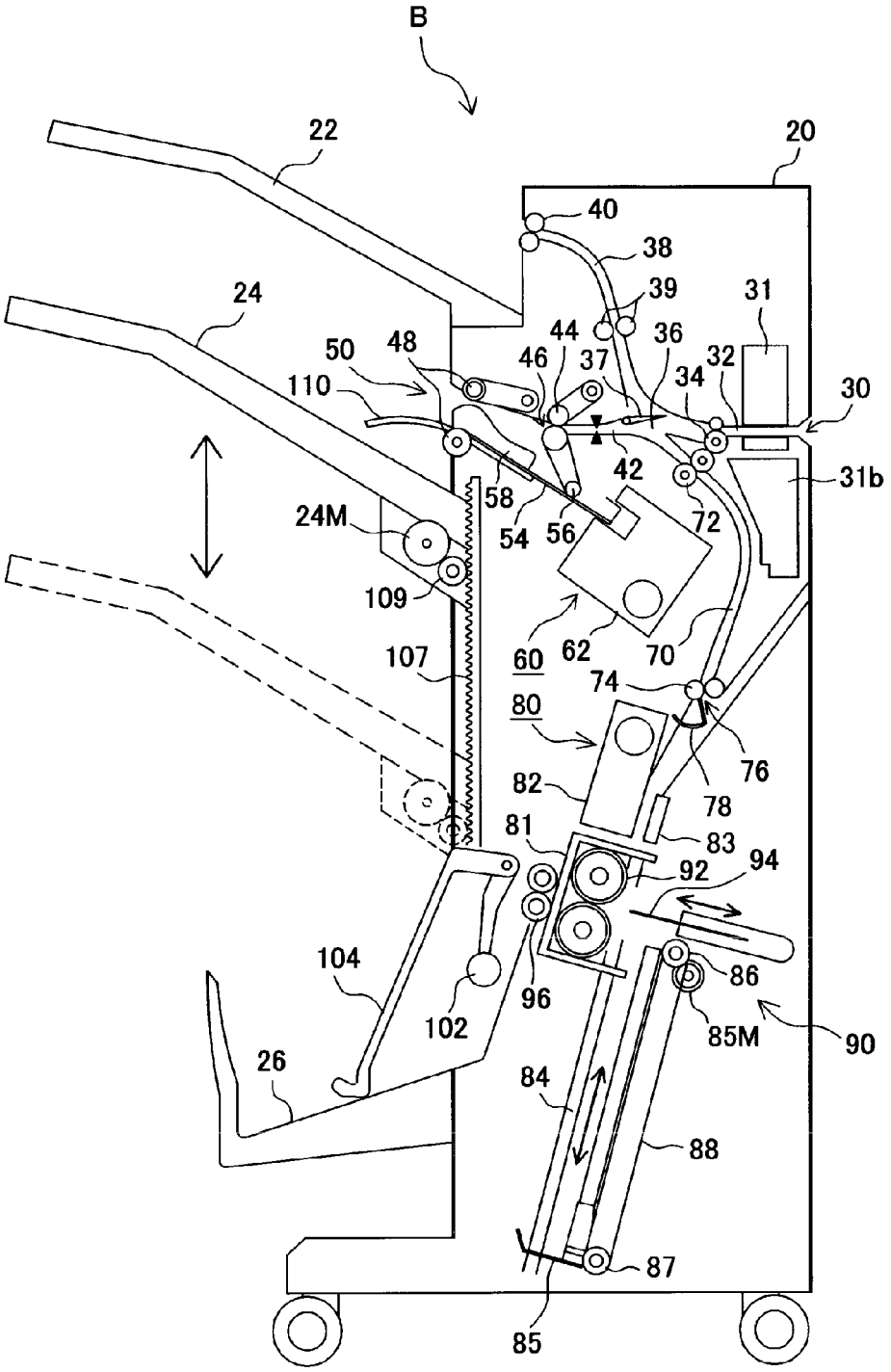
FIG. 17 is an entire explanatory view of a sheet processing apparatus in Embodiment 4 provided with an end-face stitching unit, saddle stitching unit and auxiliary guide.
Figure 18:
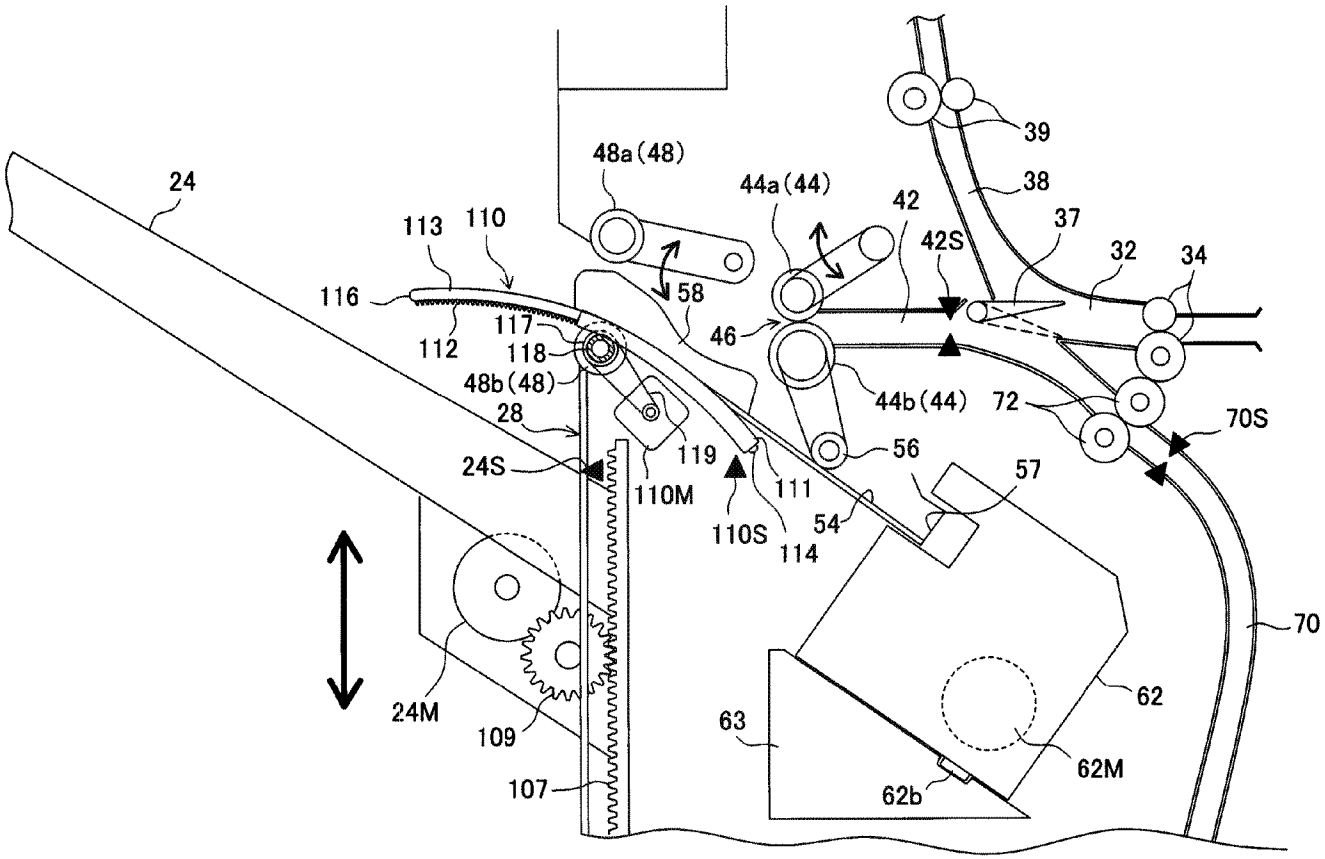
FIG. 18 is an enlarged side explanatory view on the periphery of an end-face stitching section to which is attached the auxiliary guide in FIG. 17.

Referring to FIGS. 17 to 19B, a mechanism will be described where the auxiliary guides 110 are disposed in the Embodiment shown in FIGS. 1 to 13. FIG. 17 is an entire explanatory view of a sheet processing apparatus provided with the end-face stitching unit, saddle stitching unit and auxiliary guides 110. A mechanism of the auxiliary guides 110 is shown. As shown in FIG. 18, the auxiliary guides 110 extend to the first sheet discharge tray 24 upper surface from below the first processing tray 54, and guide the lower surface of the sheet transported from the first processing tray 54.

Figure 19A:
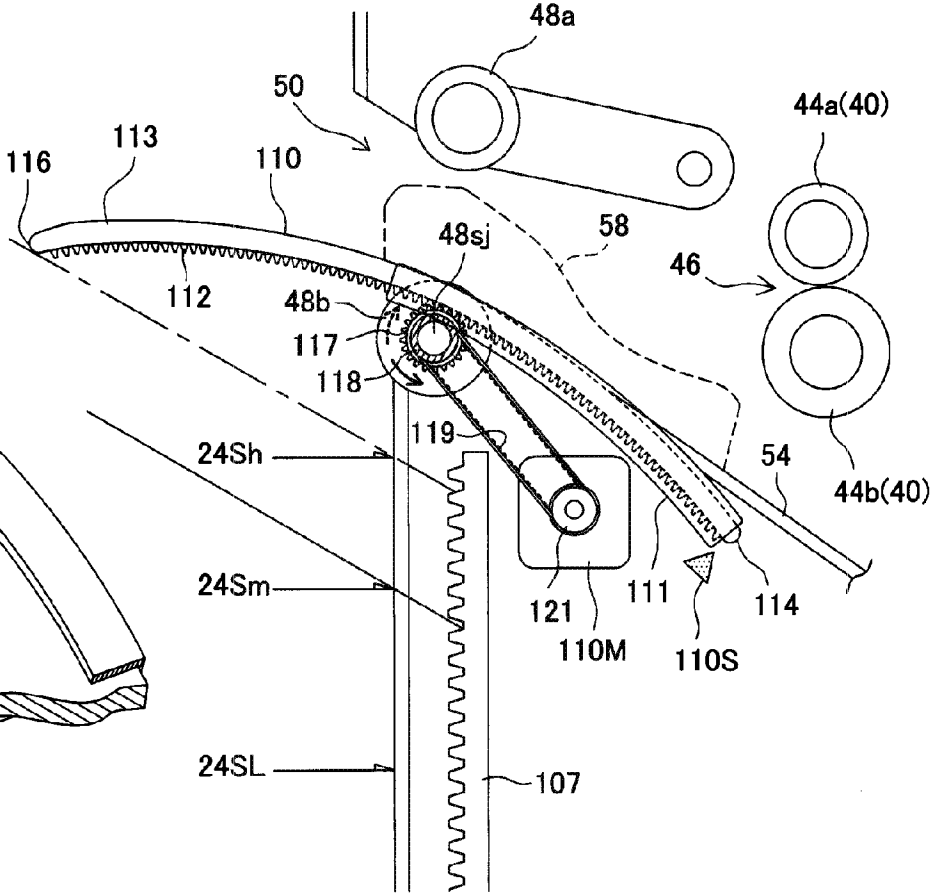
FIGS. 19A and 19B contain explanatory views of the auxiliary guide of a sheet that extends and retracts on the first sheet discharge tray, where
Figure 19B:
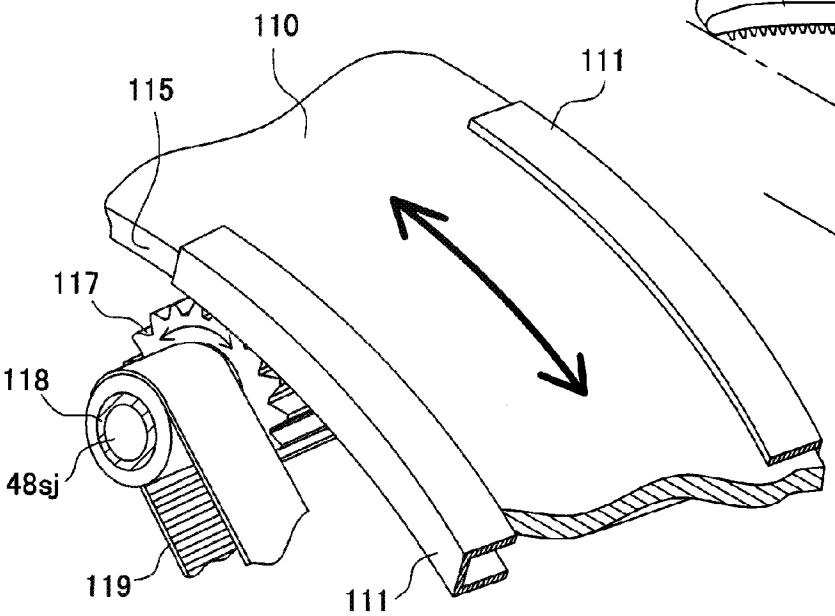

FIG. 19A illustrates the mechanism of the auxiliary guides 110 in FIG. 18, and FIG. 19B is a partial enlarged perspective view of the auxiliary guide 110.

As shown in FIGS. 19A and 19B, the auxiliary guides 110 are capable of proceeding (extending) to a guide position above the first sheet discharge tray 24 or the sheet placed on the first sheet discharge tray 24 from a storage position below the first processing tray 54. The auxiliary guides 110 are disposed while adjoining the exit lower roller 48*b* disposed in the width direction of the first processing tray exit 50. In this Embodiment, two auxiliary guides 110 are disposed in the width direction, and side portions 115 of each of the auxiliary guides 110 are supported slidably by support rails 111. Further, each of the auxiliary guides 110 is comprised of a gentle curve-shaped lever as shown in the figure, and on its backside, a guide rack 112 is formed in the entire region in its shift direction.

As shown in FIG. 19B, in the guide rack 112 engages a shift pinion 117 provided rotatably on the same shaft as the exit lower roller shaft 48*sj* of the exit lower roller 48*b*. Drive from an auxiliary guide motor 110M is transferred to the shift pinion 117 via a torque limiter with a pulley 121 and transmission belt 119.

Accordingly, by driving the auxiliary guide motor 110M, the shift pinion 117 also rotates, and the guide rack 112 meshing with the pinion also shifts according to the rotation direction, and shifts the auxiliary guide 110. For example, as shown in FIG. 19A, by rotation in the solid-line direction of the shift pinion 117, the auxiliary guide 110 is extended (proceeds) to the guide position above the first sheet discharge tray 24, and by rotation in the dashed-line direction, retracts to below the first processing tray 54 to shift in a direction of being stored in the storage position. FIG. 19B also shows the rotation of the shift pinion 117 and the shift direction of the auxiliary guide 110 by the arrows.

Recognition of an extension/retract position of the auxiliary guide 110 is performed by that an auxiliary guide sensor 110S provided on the rear end side of the support rail 111 detects a rear end 114 of the auxiliary guide 110. Further, drive from the auxiliary guide motor 110M is transferred to the auxiliary guide 110 via the torque limiter 118. Therefore, even when a front end contact portion 116 of a front end 113 of the auxiliary guide 110 comes into contact with the placement surface of the first sheet discharge tray 24 or the sheet placed on the tray, drive idles by the torque limiter 118, and the auxiliary guide 110 is not broken.

By this means, when the placement surface of the first sheet discharge tray 24 or the sheet placed on the tray is positioned in the guide position 24Sh that is a position nearer to the first processing tray exit 50, the front contact portion 116 of the auxiliary guide 110 comes into intimate contact with the placement surface or the placed sheet upper surface to eliminate the height difference, and the guide is more suitable as a guide of transport of sheets (long and short dashed-line position of the placement surface of the first sheet discharge tray 24 or the placed sheet in FIG. 19A).

The auxiliary guide 111 configured as described above acts as a sheet guide of switchback transport in the guide position, in the second tray transport to transport the sheet to the stacker 84 in the present application. This respect will be described in a subsequent flow diagram of sheets.

[Extension/retract Operation of the Auxiliary Guide]

In the "wait transport" for rotating the transport rollers 44 backward to wait in the branch path 70, and then transporting to the first processing tray 54 side again to collect in the first processing tray 54 and perform end-face stitching on a bunch of sheets shown in FIGS. 7A to 9B, the auxiliary guides 110 are retracted to below the processing tray 54, the velocity of a switchback sheet is also the same, and therefore, descriptions herein are omitted.

[Extension of the Auxiliary Guide in the Second Tray Transport for Saddle Stitching]

Referring to FIGS. 20A to 21B, described next is the "second tray transport" for rotating the transport rollers 44 backward, and switchback-transporting a sheet to feed to the stacker via the branch path 70, in order to collect sheets in the stacker 84 as the second tray (second processing tray) to perform saddle stitching in the middle portion in the sheet transport direction of a bunch of sheets.

The velocity to switchback-transport is the same as in FIGS. 10 and 11, and in order for the auxiliary guides 110 to guide the sheet to undergo switchback transport, the auxiliary guide motor 110M as shown in FIG. 18 or 19 is driven in the arrow direction shown in the figure, before the first sheet is transported (protrudes) from the first processing tray exit 50. Accordingly, the auxiliary guides 110 guide to the guide position above the placement surface of the first sheet discharge tray 24 or the sheet upper surface when the sheet is placed on the placement surface. By this means, the height difference of the standing surface 28 is reduced from the first sheet discharge tray 24 placement surface or the sheet upper surface placed on the tray in the first processing tray exit 50, the sheet to switch back is guided by the auxiliary guides 110, and fluttering and bending is suppressed.

Figure 20A:
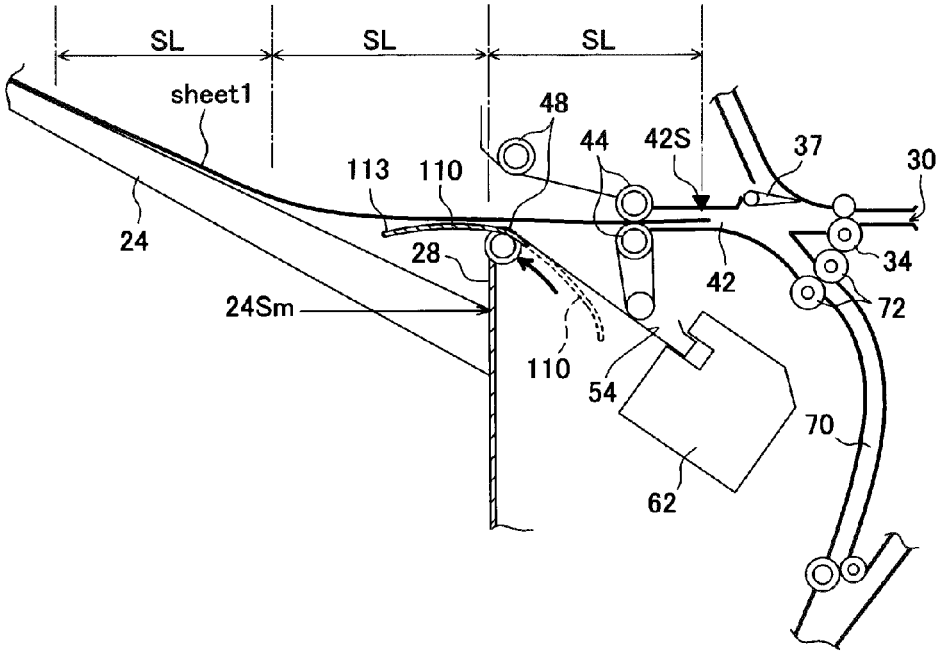
FIGS. 20A and 20B contain explanatory views according to Embodiment 4 of second tray transport to store a sheet in the stacker (second tray) for saddle stitching processing and auxiliary guide position, where
Figure 20B:
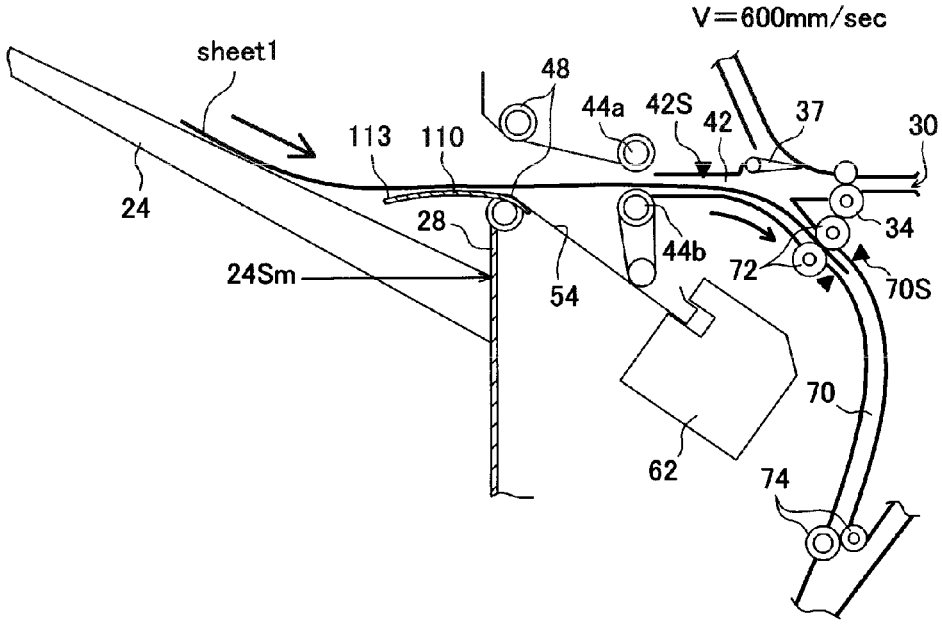

Next, as shown in FIG. 20B, the auxiliary guide 110 guides the sheet to switch back in the guide position above the placement surface of the first sheet discharge tray 24 or the placed sheet upper surface. In addition, since the transport roller motor 44M is once halted in switching from forward rotation to backward rotation, above-mentioned 600 mm/s is set as a transport target velocity, and although the average velocity is slightly lower, the velocity is reduced with this velocity as a set value. Further, at the time of switchback transport, the velocity is reduced from 1100 mm/s to 600 mm/s. This is because fluttering of a sheet particularly occurs significantly in switchback transport that is return transport of the sheet, and since the sheet is transported a relatively long distance, the velocity is reduced particularly in the return. Further, it is the same as the forgoing that when the processing speed is particularly not high speed, in reciprocating transport for discharging the sheet outside the apparatus, the velocity may be reduced from 1100 mm/s to 600 mm/s.

Figure 21A:
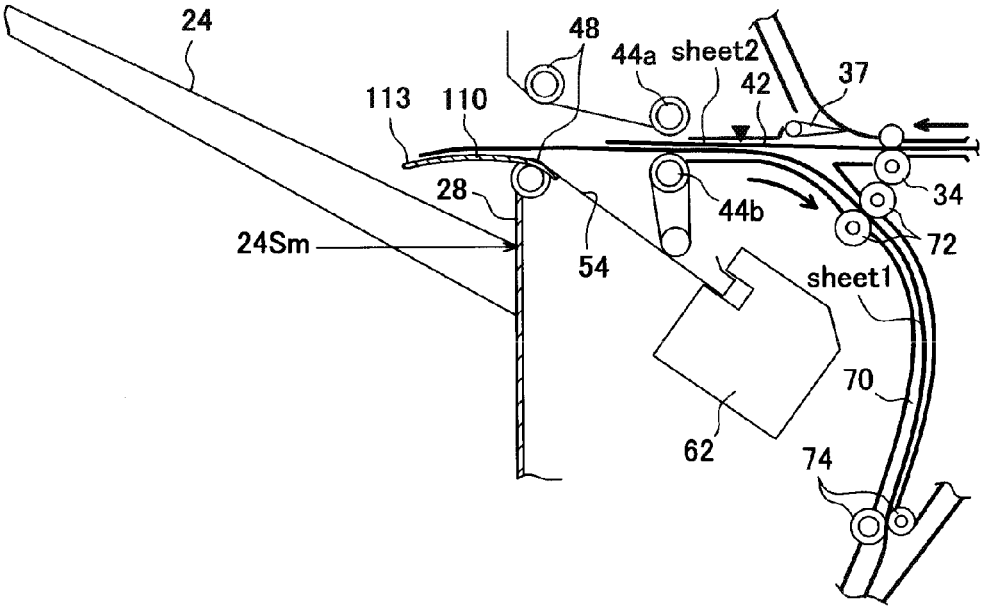
FIGS. 21A and 21B contain second tray transport operation explanatory views continued from FIGS. 20A and 20B, where
Figure 21B:
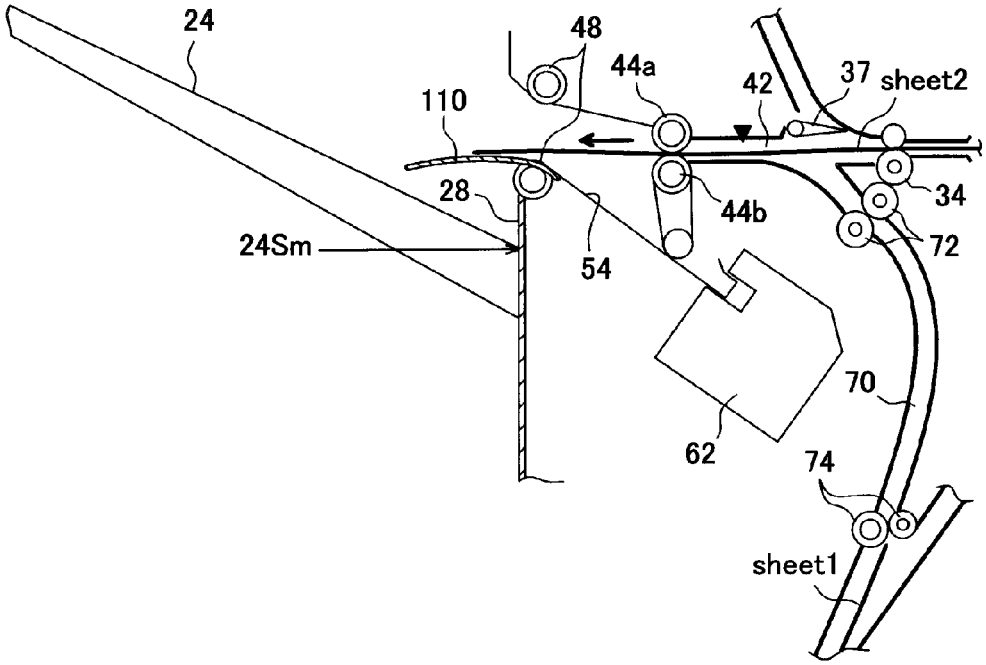

Next, also in FIG. 21A, the auxiliary guide 110 is provided to extend in the guide position in the placement surface of the first sheet discharge tray 24 or the placed sheet upper surface, reduces the height difference in the standing surface 28, and guides the sheet to switch back. Then, in FIG. 21B, since the preceding sheet is released from the branch rollers 72 and in a storage state in the stacker 84, the transport upper roller 44*a* is moved down to make the transport rollers 44 a nip state, and the sheet is transported to the first sheet discharge tray 24 side at the velocity of 1100 mm/s.

As described above, in the second tray transport for saddle stitching in FIGS. 20A to 21B, the switchback transport velocity of the transport rollers 44 is set at 600 mm/s as its set velocity, and reduced-velocity transport is performed. Further, the auxiliary guide 110 is provided to extend above the placement surface of the first sheet discharge tray 24 or the placed sheet upper surface, and guides the sheet to switch back to reduce fluttering and bending of the sheet in the switchback transport.

[Modification of the Wait Transport•••Auxiliary Guide Provided to Extend in the Wait Transport]

Figure 22A:
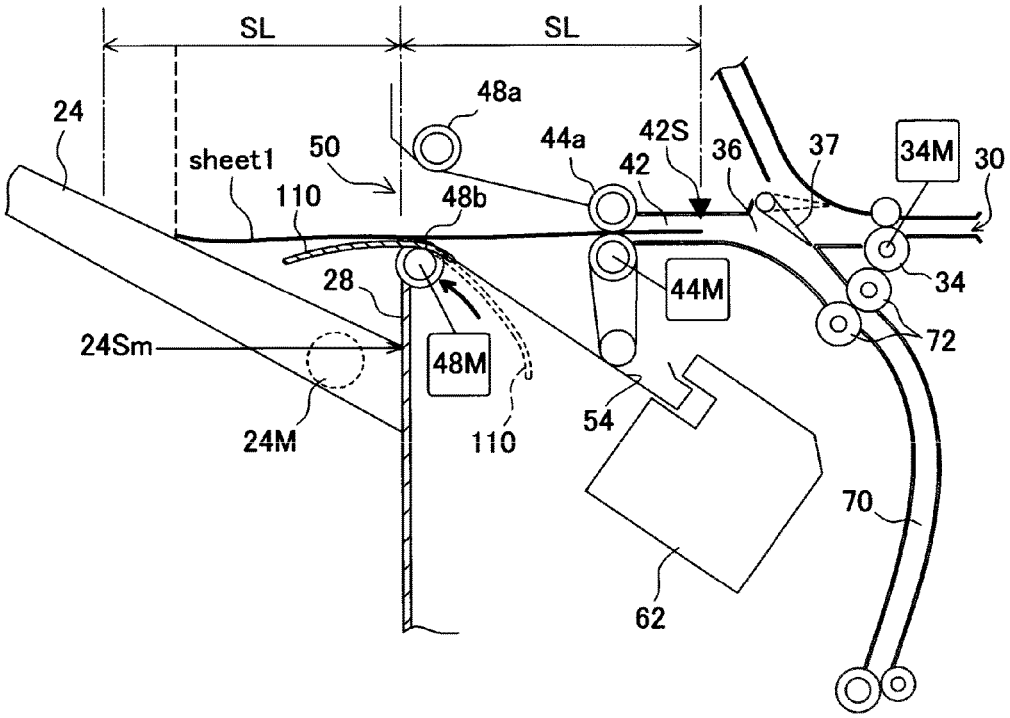
FIGS. 22A and 22B contain explanatory views of Modification of wait transport operation of a sheet to store in the first processing tray shown in FIGS. 7A and 7B and auxiliary guide position, where
Figure 22B:
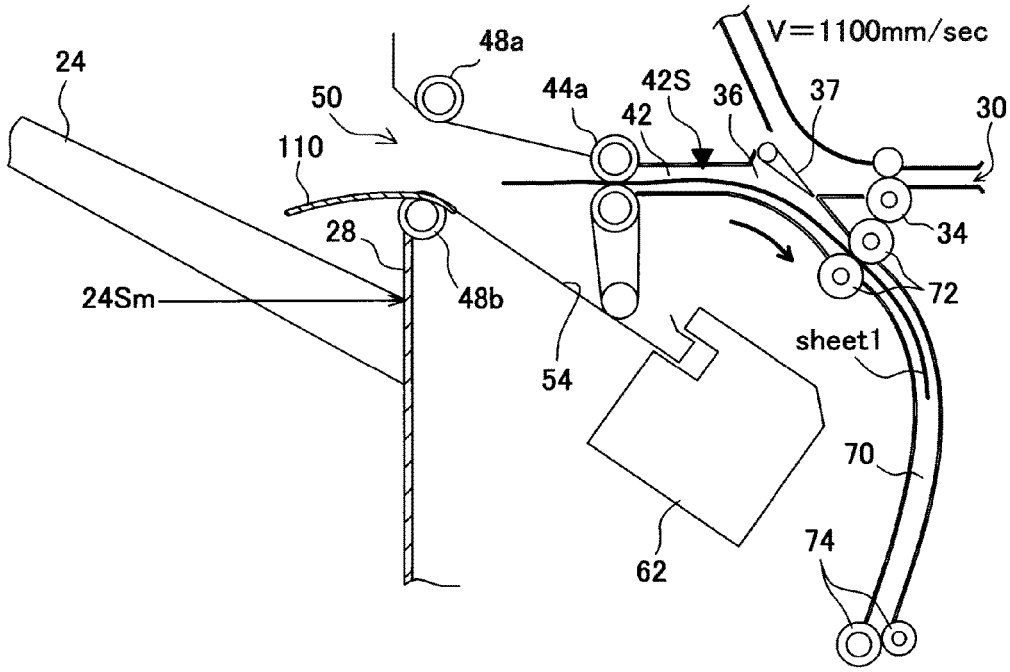

Herein, another Embodiment (Modification) of the wait transport in the end-face stitching in FIGS. 7A to 9B will be described with reference to FIGS. 22A and 22B. FIGS. 22A and 22B illustrate starting switchback transport by the transport rollers 44 to perform the wait transport as in FIGS. 7A and 7B, and FIG. 22A is an explanatory view to start switchback in the transport path. FIG. 22B illustrates a state of successively transporting from the transport path to the branch path. In this case, in FIGS. 7A and 7B, it is described that the auxiliary guide 110 is positioned in the storage position stored below the first processing tray 54 without showing in the figure. In the Modification of FIGS. 22A and 22B, the auxiliary guide 110 is provided to extend on the placement surface of the first sheet discharge tray 24 or the sheet upper surface on the placement surface. In the sheet to perform the wait transport, since the transport length exposed outside the apparatus is relatively short, although fluttering and bending does not occur to the extent of the relatively long sheet in the second tray transport, the height difference of the standing surface 28 from the first processing tray exit is reduced also herein, and more smooth switchback transport is thereby expected.

As described above, in this Modification, also in the wait transport using relatively short sheets, the auxiliary guide 110 is provided to extend in the guide position so as to transport sheets stably.

[Modification of the Second Tray Transport•••Ascent of the First Sheet Discharge Tray 24]

Figure 23A:
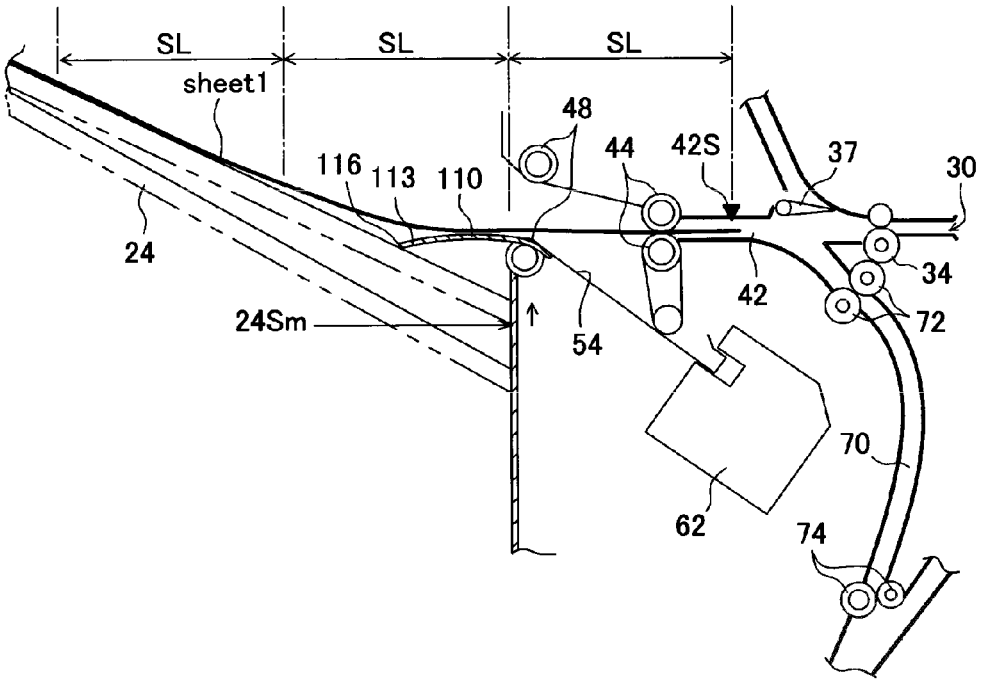
FIGS. 23A and 23B contain explanatory views of Modification of second tray transport to store a sheet in the stacker (second tray) for saddle stitching processing and auxiliary guide position shown in FIGS. 20A and 20B and first sheet discharge tray (sheet discharge tray) position added thereto, where
Figure 23B:
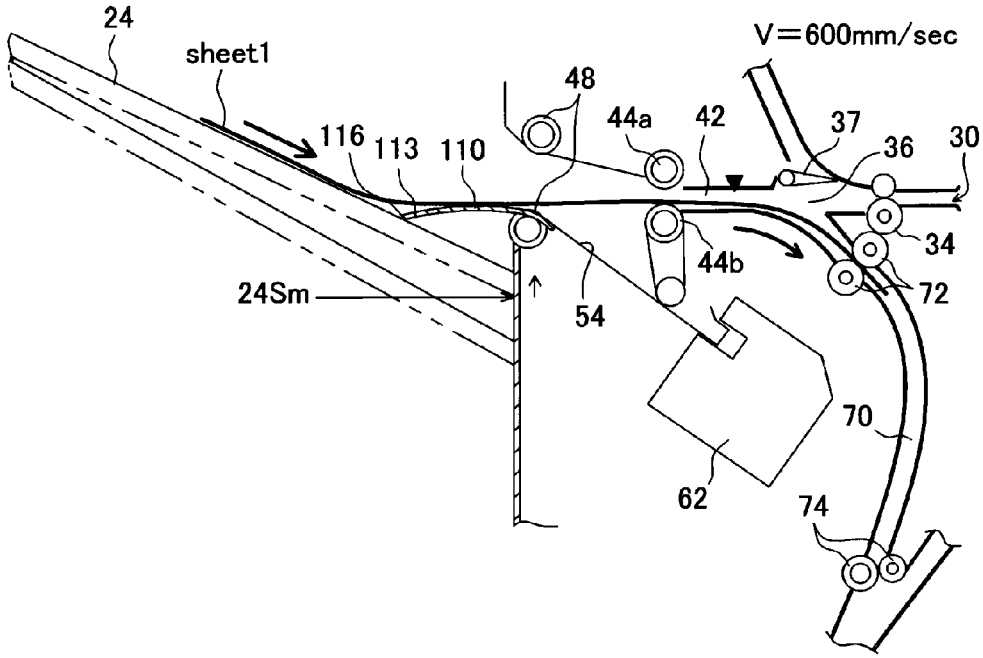

FIGS. 23A and 23B contain explanatory views of Modification where the first sheet discharge tray (sheet discharge tray) is moved up in the second tray transport to store sheets in the stacker 84 (second tray) for saddle stitching processing shown in FIGS. 20A and 20B. FIG. 23A illustrates starting switchback in the transport path, and FIG. 23B illustrate a state of successively transporting from the transport path to the branch path.

In the second tray transport, the auxiliary guide 110 is provided to extend in the guide position above the placement surface of the first sheet discharge tray 24 or the sheet placed on the placement surface, which is the same as shown in FIGS. 20A to 21B. In addition thereto, as shown in FIGS. 23A and 23B, the placement surface of the first sheet discharge tray 24 or the sheet on the placement surface is shifted to an ascent position (solid-line position) moved up to the guide position 24Sh side from the sheet receive position 24Sm (position of alternate long and two short dashed line) to receive the discharged sheet. To the ascent position, the up-and-down motor 24M for moving the first sheet discharge tray 24 up and down in FIGS. 3 and 5 is driven to move up in the direction nearest to the first processing tray exit 50 before the first sheet is transported (protrudes) from the first processing tray exit 50. By this ascent, the clearance with the front end contact portion 116 of the auxiliary guide 110 present above is eliminated, the sheet undergoing switchback transport resolves the height difference in this position between the first sheet discharge tray 24 placement surface or the sheet loaded on the placement surface and the auxiliary guide 110, and it is possible to perform switchback transport of sheets more smoothly with less fluttering.

[Description of a Control Configuration]

Figure 24:
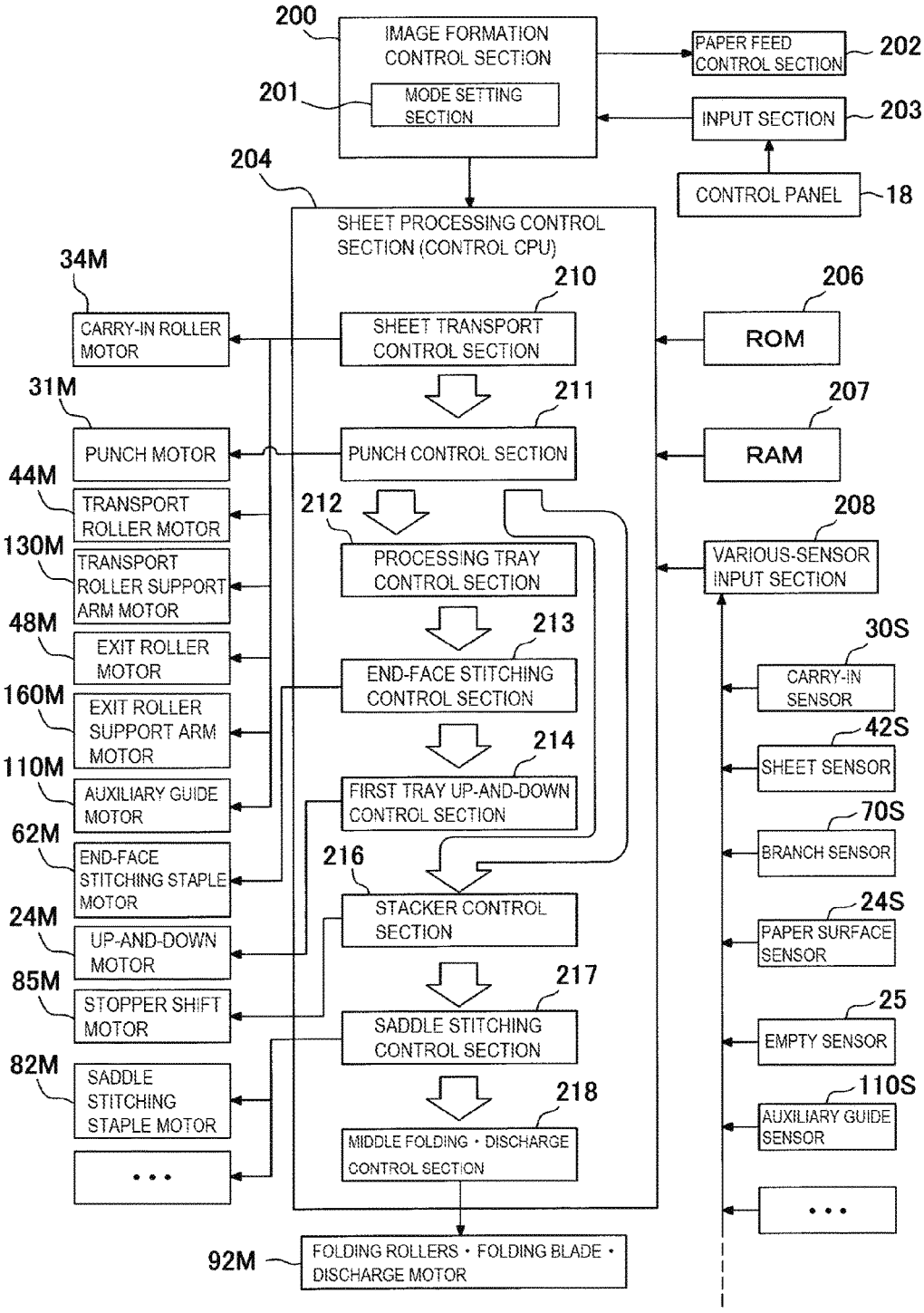
FIG. 24 is an explanatory view of a control configuration of Embodiment 4 in the entire configuration of FIG. 1.

A block diagram of FIG. 24 illustrates a system control configuration of the apparatus for performing a backup guide by auxiliary guide extension in the second tray transport, which is Embodiment 4 as described above. In this block diagram, in the sheet processing control section 204 of the block diagram of FIG. 13 descried already, to the sheet transport control section 210 is added the respect of controlling the auxiliary guide motor 110M for moving the auxiliary guide 110 forward and backward from below the first processing tray 54 to above the first sheet discharge tray 24. Further, to a various-sensor input section 208 is added an auxiliary guide 110 sensor for detecting a position of the auxiliary guide 110.

As described above, according to each of the Embodiments described above, it is possible to provide the apparatus for reducing bending and fluttering of a sheet also in transporting a relatively long sheet in switchback-transporting to carry in a different tray, and further preventing alignment characteristics from deteriorating with few occurrences of the sheet jam.

Further, the present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2015-168393 filed on Aug. 28, 2015, Japanese Patent Application No. 2015-168394 filed on Aug. 28, 2015, Japanese Patent Application No. 2015-168395 filed on Aug. 28, 2015, and Japanese Patent Application No. 2015-168396 filed on Aug. 28, 2015, incorporated herein by reference.

What is claimed is:

1. A sheet processing apparatus comprising:

a transport path adapted to receive a sheet to transport the sheet to a first tray;

a branch path branched off from the transport path to transport a sheet to a second tray;

a first transport roller positioned in the transport path on a downstream side of a branch position of the transport path and the branch path to be able to transport a sheet in a direction of one of both the first tray and the branch path;

a second transport roller positioned in the branch path to be able to transport a sheet in a direction of one of both the second tray and the transport path; and a control section to control the first transport roller and the second transport roller, wherein the control section performs a first transport for switchback-transporting a preceding sheet to cause the preceding sheet to temporarily wait in the branch path after the preceding sheet transported in the transport path passes through the branch position, and transporting the preceding sheet to the first tray together with a subsequent sheet, and a second transport for switchback-transporting a sheet to transport to the second tray via the branch path after the sheet transported in the transport path passes through the branch position, and makes a switchback transport velocity of the second transport different from a switchback transport velocity of the first transport.

2. The sheet processing apparatus according to claim 1, wherein the switchback transport velocity of the second transport is lower than the switchback transport velocity of the first transport.

3. The sheet processing apparatus according to claim 2, wherein a sheet discharge tray for collecting sheets is disposed on a downstream side of the first tray disposed in a downstream end of the transport path, an end-face stitching unit for binding end faces of a bunch of sheets is arranged in the first tray, and a saddle stitching unit for binding substantially a center in a sheet transport direction of a bunch of sheets is arranged in the second tray.

4. The sheet processing apparatus according to claim 3, wherein the first transport roller includes a pair of rollers supported to be able to shift between a press-contact position where the pair of rollers is press-contacted each other to nip the sheet to transport and a separate position where the pair of rollers is separated each other to release a nip of the sheet, and after the sheet is nipped by the second transport roller in switchback transport in the second transport, the control section shifts the first transport roller to the separate position to enable a next sheet to be received.

5. The sheet processing apparatus according to claim 1, wherein the control section recognizes a length of a transported sheet in the transport path, and when the transported sheet is shorter than a predetermined length, makes the switchback transport velocity of the second transport substantially the same as the switchback transport velocity of the first transport.

6. An image formation apparatus comprising:

an image formation section adapted to form an image on a sheet sequentially; and a sheet processing apparatus adapted to perform predetermined processing on the sheet from the image formation section, wherein the sheet processing apparatus is provided with a configuration as described in claim 1.

7. A sheet processing apparatus comprising:

a transport path adapted to receive a sheet to guide the sheet;

a first tray positioned on a downstream side of the transport path to receive a sheet;

a sheet discharge tray movably positioned on a downstream side of the first tray to collect a sheet discharged from an exit of the first tray;

a branch path branched off from the transport path to guide a sheet;

a second tray adapted to receive a sheet transported from the branch path;

a first transport roller positioned in the transport path on a downstream side of a branch position of the transport path and the branch path to be able to transport a sheet to one of both the first tray and the branch path;

a second transport roller positioned in the branch path to be able to transport a sheet to one of both the second tray and the transport path; and a control section to control the first transport roller, the second transport roller and the sheet discharge tray, wherein the control section performs a first transport for switchback-transporting a preceding sheet to cause the preceding sheet to temporarily wait in the branch path after the preceding sheet transported in the transport path passes through the branch position, and transporting the preceding sheet to the first tray together with a subsequent sheet, and a second transport for switchback-transporting a sheet to transport to the second tray via the branch path after the sheet transported in the transport path passes through the branch position, and in the second transport, an upper surface of the sheet discharge tray or an upper surface of a sheet placed on the sheet discharge tray shifts to a position for guiding a sheet undergoing switchback transport.

8. The sheet processing apparatus according to claim 7, wherein an end-face stitching unit for binding end faces of a bunch of sheets is arranged in the first tray, and a saddle stitching unit for binding substantially a center in a sheet transport direction of a bunch of sheets is arranged in the second tray.

9. The sheet processing apparatus according to claim 8, wherein the control section shifts the upper surface of the sheet discharge tray or the upper surface of the sheet placed on the sheet discharge tray in a direction closer to the exit in the second transport than the first transport to guide a sheet undergoing switchback transport to the second tray.

10. The sheet processing apparatus according to claim 9, wherein in the first transport, the control section shifts the upper surface of the sheet discharge tray or the upper surface of the sheet placed on the sheet discharge tray to a position more separate from the exit than in receiving a sheet discharged from the first tray.

11. The sheet processing apparatus according to claim 7, wherein a switchback transport velocity of the second transport is lower than a switchback transport velocity of the first transport.

12. The sheet processing apparatus according to claim 11, wherein the first transport roller includes a pair of rollers to be able to shift between a press-contact position where the pair of rollers is press-contacted each other to nip the sheet to transport and a separate position where the pair of rollers is separated each other to release a nip of the sheet, and after the sheet is nipped by the second transport roller in switchback transport in the second transport, the control section shifts the first transport roller to the separate position to enable a next sheet to be received.

13. A sheet processing apparatus comprising:

a transport path adapted to receive a sheet to guide the sheet;

a first tray positioned on a downstream side of the transport path to receive a sheet;

a sheet discharge tray movably positioned on a downstream side of the first tray to collect a sheet discharged from an exit of the first tray;

a branch path branched off from the transport path to guide a sheet;

a second tray adapted to receive a sheet transported from the branch path;

a first transport roller positioned in the transport path on a downstream side of a branch position of the transport path and the branch path to be able to transport a sheet to one of both the first tray and the branch path;

a second transport roller positioned on the branch path to be able to transport a sheet to one of both the second tray and the transport path;

an auxiliary guide provided to extend above the sheet discharge tray or above the sheet collected on the sheet discharge tray and shift between a guide position for guiding a sheet transported from the exit of the first tray and a storage position stored below the first tray; and a control section to control the first transport roller, the second transport roller and a shift of the auxiliary guide, wherein the control section performs a first transport for switchback-transporting a preceding sheet to cause the preceding sheet to temporarily wait in the branch path after the preceding sheet transported in the transport path passes through the branch position, and transporting the preceding sheet to the first tray together with a subsequent sheet, and a second transport for switchback-transporting a sheet to transport to the second tray via the branch path after the sheet transported in the transport path passes through the branch position, and in the second transport, the control section shifts the auxiliary guide to the guide position to guide a sheet undergoing switchback transport.

14. The sheet processing apparatus according to claim 13, wherein an end-face stitching unit for binding end faces of a bunch of sheets is arranged in the first tray, and a saddle stitching unit for binding substantially a center in a sheet transport direction of a bunch of sheets is arranged in the second tray.

15. The sheet processing apparatus according to claim 14, wherein the control section further shifts an upper surface of the sheet discharge tray or an upper surface of a sheet placed on the sheet discharge tray in a direction closer to the exit of the first tray to guide a sheet undergoing switchback of the second transport in cooperation with the auxiliary guide positioned in the guide position.

16. The sheet processing apparatus according to claim 15, wherein in the first transport, the control section positions the auxiliary guide in the storage position, and shifts the upper surface of the sheet discharge tray or the upper surface of the sheet placed on the sheet discharge tray to a position more separate from the exit of the first tray than in receiving a sheet discharged from the first tray.

17. The sheet processing apparatus according to claim 14, wherein a switchback transport velocity of the second transport is lower than a switchback transport velocity of the first transport.

18. The sheet processing apparatus according to claim 17, wherein the first transport roller includes a pair of rollers to be able to shift between a press-contact position where the pair of rollers is press-contacted each other to nip the sheet to transport and a separate position where the pair of rollers is separated each other to release a nip of the sheet, and after the sheet is nipped by the second transport roller in switchback transport of the second transport, the control section shifts the first transport roller to the separate position to enable a next sheet to be received.

* * * * *